US008319591B2

(12) United States Patent
Fujiyama

(10) Patent No.: US 8,319,591 B2
(45) Date of Patent: Nov. 27, 2012

(54) IGNITION COIL WITH CORE FORMED OF COMPRESSED POWDER

(75) Inventor: Norihito Fujiyama, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/304,522

(22) Filed: Nov. 25, 2011

(65) Prior Publication Data

US 2012/0133470 A1 May 31, 2012

(30) Foreign Application Priority Data

Nov. 25, 2010 (JP) ..... 2010-262015

(51) Int. Cl.

| | |
|---|---|
| ***H01F 27/02*** | (2006.01) |
| ***H01F 27/08*** | (2006.01) |
| ***H01F 27/06*** | (2006.01) |
| ***H01F 27/29*** | (2006.01) |
| ***H01F 27/30*** | (2006.01) |
| ***H01F 38/12*** | (2006.01) |
| ***F02P 31/02*** | (2006.01) |

(52) U.S. Cl. ..... 336/90; 336/60; 336/65; 336/92; 336/192; 336/198; 123/634; 123/635

(58) Field of Classification Search ..... 336/60, 336/65, 90, 92, 192, 198; 123/634, 635
See application file for complete search history.

(56) References Cited

U.S. PATENT DOCUMENTS

| | | | | |
|---|---|---|---|---|
| 5,426,844 | A * | 6/1995 | Suda et al. | 29/606 |
| 5,632,259 | A * | 5/1997 | Konda et al. | 123/634 |
| 6,055,969 | A * | 5/2000 | Oishi et al. | 123/635 |
| 6,073,598 | A * | 6/2000 | Trozzi | 123/179.3 |
| 6,188,304 | B1 | 2/2001 | Skinner et al. | |
| 2002/0057181 | A1 * | 5/2002 | Sato et al. | 336/221 |
| 2004/0056746 | A1 * | 3/2004 | Schloss et al. | 336/90 |
| 2009/0071454 | A1 * | 3/2009 | Fujiyama | 123/621 |
| 2009/0090435 | A1 | 4/2009 | Hoshina et al. | |

FOREIGN PATENT DOCUMENTS

| | | |
|---|---|---|
| JP | A-2004-319749 | 11/2004 |
| JP | A-2007-324270 | 12/2007 |
| JP | A-2010-126786 | 6/2010 |

* cited by examiner

*Primary Examiner* — Mohamad Musleh
*Assistant Examiner* — Ronald Hinson
(74) *Attorney, Agent, or Firm* — Oliff & Berridge, PLC

(57) ABSTRACT

A primary coil of an ignition coil has a socket with a side wall having an opening, a center core having a body portion with a root located in the opening and a collar portion extending perpendicularly from the root, and a winding wound on the body portion while the socket catches start and end portions of the winding on respective winding start and end sides. The collar portion is held in the socket. The core is formed by compressing magnetic powder in two divided dies divided through dividing lines which extend along a diagonal line of a rectangle formed by projecting the collar portion on a plane perpendicular to a center axis of the core. The root on the diagonal line is exposed to the opening on the winding start side and is covered with the side wall on the winding end side.

11 Claims, 16 Drawing Sheets

IGNITION COIL WITH CORE FORMED OF COMPRESSED POWDER

CROSS-REFERENCE TO RELATED APPLICATION

This application is based upon and claims the benefit of priority of the prior Japanese Patent Application 2010-262015 filed on Nov. 25, 2010, so that the contents of which are incorporated herein by reference.

BACKGROUND OF THE INVENTION

1. Field of the Invention

The present invention relates generally to an ignition coil of an internal combustion engine which generates a high voltage to be applied to a spark plug, and more particularly to the ignition coil in which a center core is formed of compressed magnetic powder compressed and molded by divided dies.

2. Description of Related Art

An ignition coil has a primary coil and a secondary coil performing mutual induction with each other, and the primary coil has a center core. To enhance the effect of the mutual induction, the center core are disposed inside both the primary coil and the secondary coil. As the center core, a laminated core having the lamination of silicon steel sheets and a compressed powder core, obtained by compressing and molding particles of magnetic powder covered with an insulator, are well known.

Because the surface of the compressed powder core is smooth or glassy as compared with the surface of the laminated core, the compressed powder core has been used as a center core. In recently, to minimize the ignition coil, a winding is directly wound on the compressed powder core without using any winding frame. Further, the compressed powder core can be easily molded in a complicated shape, as compared with the laminated core. Therefore, a winding body portion of the compressed powder core is formed in a columnar shape with a step, and the winding is wounded on the winding body portion. In this case, the number of turns in the winding can be increased without enlarging the compressed powder core.

Published Japanese Patent First Publication No. 2007-324274 discloses a method of producing a compressed powder core of low iron loss. In this method, a mechanical shock is given to raw material of magnetic powder produced according to the water atomizing method to form each of particles of the magnetic powder in a spherical shape, the magnetic powder is annealed to remove distortion from the magnetic powder, the magnetic powder is covered with an insulator made of a component of heat resisting organic resin such as silicon resin to insulate the particles of the magnetic powder from one another, and warm compression molding is performed for the magnetic powder to form a compressed powder core of low iron loss. This compressed powder core used as the center core of an ignition coil is composed of a winding body portion, formed in a columnar shape with a step, and a collar portion. The body portion has a larger diameter portion and a smaller diameter portion. The collar portion extends from the end of the smaller diameter portion in directions, being perpendicular to the center axis of the body portion, substantially in a rectangular shape, and is formed in a rectangular parallelepiped shape. A winding is wound on the body portion. The collar portion fixedly catches a winding start portion and a winding end portion of the winding. The collar portion is inserted into a connector socket, so that this socket receiving the collar portion fixedly holds the center core.

Because the outer shape of the compressed powder core used for the ignition coil has a step, when this core is formed by using an integrally-formed molding die, it is difficult to release the core from the die. Therefore, a plurality of divided dies are prepared by dividing a molding die having a step shape, and the compressed powder core is formed by using these divided dies. However, when magnetic powder is compressed and molded by using these divided dies, burrs are inevitably formed on the outer circumferential surface of the compressed powder core along dividing lines between the divided dies. More specifically, to prevent the dies from being broken, edges of each divided die placed on contact faces to be in contact with faces of the other divided die are cut out in advance to form chamfered planes on the contact faces of the divided die. These chamfered planes form openings along the dividing lines of the divided dies when the divided dies are brought into contact with one another. Further, other small openings are formed along the dividing lines of the divided dies due to wear caused by the use of the divided dies. Therefore, when magnetic powder is packed into the dies, the powder goes into these openings and is compressed to form burrs. These burrs extend along the dividing lines of the divided dies, on the outer circumferential surface of the compressed powder core.

When a winding is directly wound on the compressed powder core with these burrs, the insulator covering the coil is cut by the burrs, and the primary coil sometimes causes a short circuit. To prevent the primary coil from causing a short circuit, it is required to remove burrs formed on the surface of the compressed powder core by grinding or the like. Burrs formed on the outer circumferential surface of the body portion, of which the diameter is gradually changed, can be easily removed by using a well-known method such as buffing or blasting.

However, it is difficult to perfectly remove burrs, formed on a root of the winding body portion extending from the collar portion to be perpendicular to the collar portion, by a simple method. Therefore, burrs formed in the root sometimes remain slightly.

Further, the compressed powder core has a low tenacity or toughness. Therefore, when the compressed powder core is integrally formed with a connector socket by an insert molding, the collar portion is sometimes broken. To prevent this brakeage of the collar portion, it is required to insert the collar portion into a connector socket formed in a box shape by a so-called outsert molding and to form a unit of the socket and the compressed powder core fixed into the socket. In this molding, a portion of a side wall of the Socket forming the box is cut to form an opening. The root of the winding body portion passes through the opening during the insertion of the collar portion to be placed in the opening.

However, in this unit of the socket and the compressed powder core inserted into the socket by the outsert molding, burrs remaining on the root of the body portion are undesirably protruded from the opening of the socket. Therefore, when a winding is wound on the body portion of the compressed powder core by a predetermined number of turns in a multi-layer, one turn of winding in the second layer is pushed toward an opening between a first turn of winding nearest to the collar portion and a second turn of winding adjacent to the first turn in the first layer. Because a winding portion, not in contact with the side wall of the socket but facing the opening, in the first turn of winding is not supported by the side wall, this winding portion is bent toward the collar portion. In this case, the burrs protruded from the opening of the socket sometimes damage the insulator of the first turn of winding so as to cause a short circuit in the primary coil.

SUMMARY

Thus it is desired to provide, with due consideration to the drawbacks of the conventional ignition coil, an ignition coil with a primary coil, having a center core formed by compressing magnetic powder, which acts at a high reliability while the primary coil reduces the incidence rate of short circuits.

According to a first aspect of this disclosure, there is provided an ignition coil having a primary coil which comprises a center core formed by compressing magnetic powder packed in a core die, a connector socket formed in a cylindrical shape, and a winding. The center care has a smaller diameter portion, a larger diameter portion, and a collar portion. A winding body portion is composed of the smaller diameter portion and the larger diameter portion and is formed substantially in a columnar shape with a step. The collar portion extends from a root of the smaller diameter portion in outer directions, perpendicular to a center axis of the center core, so as to form substantially a rectangle on a plane perpendicular to the center axis. The connector socket has a bottom wall, a side wall surrounding the bottom wall so as to have an opened end and an opening, a winding start catching portion disposed on the side wall on a winding start side of the side wall, and a winding end catching portion disposed on the side wall on a winding end side of the side wall. The opened end is placed opposite to the bottom wall through the side wall. The opening extends from the opened end toward the bottom wall. The collar portion of the center core is fixedly held in a space surrounded by the bottom wall and the side wall. The root of the smaller diameter portion is located in the opening. The winding is wound on the winding body portion while a winding start portion of the winding is caught by the winding start catching portion and while a winding end portion of the winding is caught by the winding end catching portion. The core die is composed of two divided dies divided through a dividing line which extends along a diagonal line of the rectangle of the collar portion packed in the dies. The root of the smaller diameter portion is exposed to the opening of the connector socket on a segment of the diagonal line, positioned on the winding start side, while the root is substantially covered with the side wall on another segment of the diagonal line positioned on the winding end side.

With this structure of the ignition coil, the winding start portion of the winding is caught by the winding start catching portion disposed on the side wall on the winding end side. Further, the winding is wound on the winding body portion while forming turns of winding in a plurality of winding layers in a regular winding shape, and a specific turn of winding, from which the winding start portion extends, is directly in contact with the smaller diameter portion in the first winding layer and is supported by the side wall of the collar portion. Therefore, the winding start portion extending from the specific turn of winding and being caught by the winding start catching portion is hardly deformed. Further, the specific turn of winding supported by the side wall of the collar portion is hardly bent.

Therefore, even when a burr remains on the root, exposed to the opening on a segment of the diagonal line positioned on the winding start side, the burr hardly damages the winding. Further, even when a burr remains on the root covered with the side wall on a segment of the diagonal line positioned on the winding end side, this burr does not damages the winding.

Accordingly, the ignition coil with the primary coil, having the center core formed by compressing magnetic powder, can act at a high reliability while the primary coil reduces the incidence rate of short circuits.

According to a second aspect of this disclosure, there is provided an ignition coil having a primary coil which comprises the center core formed by using a core die, the connector socket, and the winding. The core die is composed of two divided dies divided through a dividing line extending along a center line which partitions the rectangle of the collar portion of the center core, located in the divided dies, into two equal parts and is substantially perpendicular to a direction directed from the opened end to the bottom wall of the connector socket holding the center core.

With this structure of the ignition coil, because the center line of the rectangle is substantially perpendicular to the direction directed from the opened end to the bottom wall, the root of the smaller diameter portion is covered with the side wall surrounding the opening on segments of the center line. Therefore, even when burrs remain on the root on the segments of the center line, the burrs are not exposed to the opening, and these burr do not damages the winding wound on the winding body portion.

Accordingly, the ignition coil with the primary coil, having the center core formed by compressing magnetic powder, can act at a high reliability while the primary coil reduces the incidence rate of short circuits.

DETAILED DESCRIPTION OF THE PREFERRED EMBODIMENTS

Figure 1:
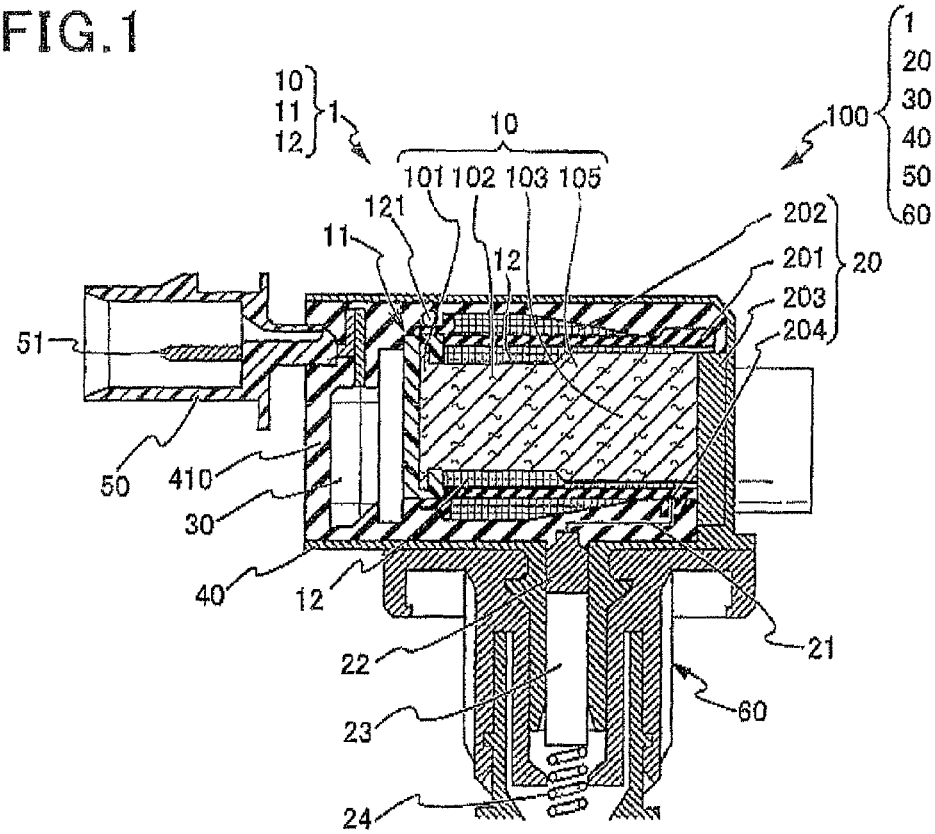
FIG. 1 is a longitudinal sectional view of an ignition coil according to the first embodiment of the present invention.

Embodiments of the present invention will now be described with reference to the accompanying drawings, in which like reference numerals indicate like parts, members or elements throughout the specification unless otherwise indicated.

In the present invention, an ignition coil having a primary coil and a secondary coil generates a high voltage of electric power to be applied to a spark plug in an internal combustion engine. A center core of the primary coil is formed by compressing and molding magnetic powder by using two molding dies divided along dividing lines. A collar portion of the center core has a rectangular surface forming a rectangle obtained by projecting the surface onto a plane perpendicular to a center axis of the center core. The dividing lines of the dies are set so as to extend along a specific line such as a diagonal line of the rectangle or a center line partitioning each of two opposite sides (e.g., two longer sides or two shorter sides) of the rectangle into two equal segments. Lines of dividing trace are formed on the outer surface of the center core along the dividing lines. The collar portion is disposed in a connector socket while a root of a body portion, from which the collar portion extends, is located in an opening formed in a side wall of the socket. Even when burrs remain on the root of the body portion on the dividing trace line, the center core is held by the socket such that the burrs do not damage a winding wound on the body portion. Therefore, the ignition coil can prevent the primary coil, obtained by directly winding the primary winding on the center core, from causing a short circuit.

First Embodiment

Figure 2:
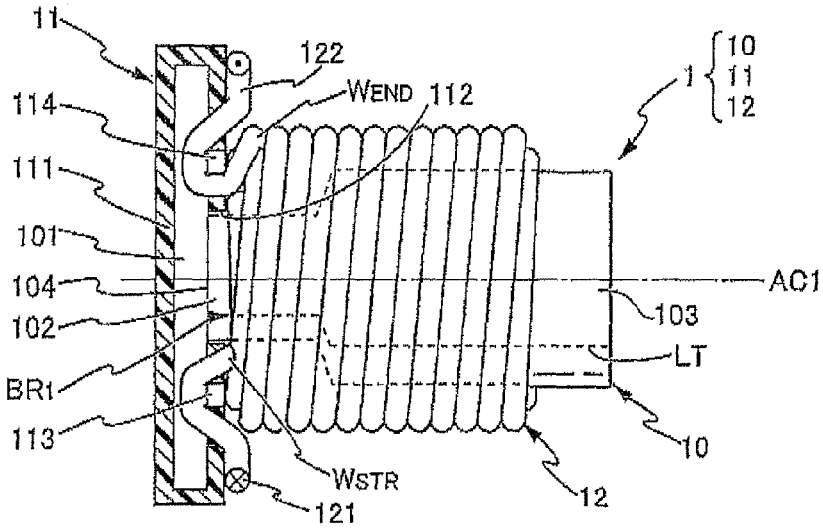
FIG. 2 is a side view of a primary coil of the ignition coil connected with a connector socket according to the first embodiment.

FIG. 1 is a longitudinal sectional view of an ignition coil according to the first embodiment, and FIG. 2 is a side view of a primary coil of the ignition coil connected with a connector socket. As shown in FIG. 1, an ignition coil 100 has a primary coil 1, a secondary coil 20 formed substantially in a cylindrical shape so as to surround the coil 1, an igniter 30, a housing 40 accommodating the coils 1 and 20 and the igniter 30, an input connector 50, and a fixing portion 60 fixed to a head of an engine to fix the coil 100 to the engine of a vehicle.

As shown in FIG. 1 and FIG. 2, the primary coil 1 has a center core 10, a primary winding 12 directly wound on the core 10 and a connector socket 11 fixedly holding the core 10. The core 10 is composed of a collar portion 101, a smaller diameter portion 102 extending from the portion 101, a diameter changing portion 105 extending from the portion 102, and a larger diameter portion 103 extending from the portion 105. These portions 101, 102, 103 and 105 of the core 10 extend along a center axis Ac1 of the core 10. The collar portion 101 extends from a root 104 (see FIG. 2) of the smaller diameter portion 102 along outer directions, being perpendicular to the center axis Ac1, substantially in a rectangular shape to be formed in a rectangular parallelepiped shape. The portion 101 has surfaces forming substantially a rectangle on a plane perpendicular to the center axis Ac1. Each of the portions 102 and 103 are formed in a columnar shape. The diameter changing portion 105 is formed in a taper shape, and the diameter of the portion 105 is successively changed to smoothly change the diameter of the core 10 between the portions 102 and 103. The portions 102, 103 and 105 forms a winding body portion having a step on the outer circumferential surface. The winding 12 is directly wound on the winding body portion of the core 10 by a predetermined number of turns in layers to be formed in a regular winding shape. The collar portion 101 prevents the winding 12 wound on the winding body from being shifted along the center axis Ac1 without keeping the regular winding shape.

Figure 3:
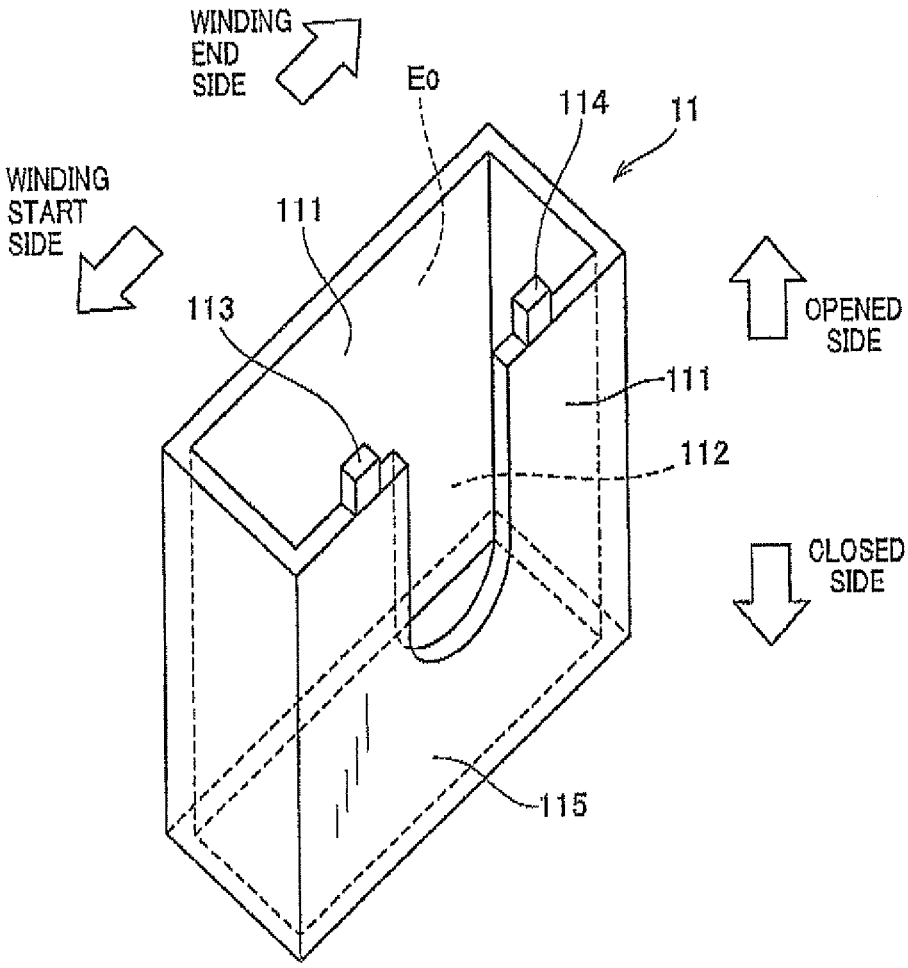
FIG. 3 is a perspective side view of a connector socket of the primary coil.

FIG. 3 is a perspective side view of the socket 11. As shown in FIG. 3, the socket 11 is made of resin having the insulation performance and is formed in a cylindrical shape having a bottom. More specifically, the socket 11 is formed in a box shape and has one bottom wall 115 and a side wall 111 surrounding the bottom wall 115. The socket 11 has an opened end E opened on the side opposite to the bottom wall 115. An opening 112 is formed in the side wall 111 on one side surface of the socket 11 so as to extend from the opened end Eo toward the bottom wall 115. Further, the socket 11 has a winding start catching portion 113 and a winding end catching portion 114 on the opened end Eo of the socket 11.

The collar portion 101 of the core 10 is inserted into the space of the socket 11, surrounded by the walls 111 and 115, through the opened end Eo of the socket 11 while the smaller diameter portion 102 passes through the opening 112. Therefore, as shown in FIG. 2, the collar portion 101 is disposed in the socket 11, and the root 104 of the smaller diameter portion 102 is located into the opening 112. The width of the opening 112 is substantially equal to the diameter of the portion 102, and the diameter of a semicircle of the opening 112 located nearest to the bottom wall 115 of the socket 11 is substantially equal to or slightly larger than the diameter of the portion 102. Therefore, one half of the root 104 located on an opened side of the smaller diameter portion 102, on which the catching portions 113 and 114 are located, is exposed to the opening 112, while the other half of the root 104 located on a closed side of the smaller diameter portion 102 opposite to the opened side is not exposed to the opening 112 but is covered with the side wall 111 surrounding the semicircle of the opening 112. The socket 11 receiving the collar portion 101 fixedly holds the center core 10 at a predetermined position within the housing 40. The collar portion 101 is covered with the socket 11 except for the opening 112.

As shown in FIG. 2, the catching portion 113 catches a winding start terminal portion 121 of the winding 12 on a winding start side of the smaller diameter portion 102. The terminal portion 121 extends from a winding start point $W_{STR}$ from which the winding 12 starts forming turns of winding to be wound on the smaller diameter portion 102. The catching portion 114 catches a winding end terminal portion 122 of the winding 12 on a winding end side of the smaller diameter portion 102 opposite to the winding start side. The terminal portion 122 extends from a winding endpoint $W_{END}$ at which the winding 12 ends forming the turns of winding. Therefore, the socket 11 can fixedly receive the terminal portions 121 and 122 of the winding 12 at the catching portions 113 and 114 on the opened side.

Because the body portion of the core 10 is formed in the columnar shape with a step, the number of winding layers (e.g., four) in the winding 12 wound on the smaller diameter portion 102 is larger than the number of winding layers (e.g., two) on the larger diameter portion 103. Therefore, the number of turns in the winding 12 wound on the smaller diameter portion 102 can be larger than the number of turns on the larger diameter portion 103, and the number of turns can be increased without forming the coil 1 in a larger size.

The secondary coil 20 shown in FIG. 1 is disposed coaxially with the primary coil 1 to be placed outside the primary coil 1. The coil 20 has a winding frame 201 substantially formed in a cylindrical shape, a secondary winding 202 connected with the terminal portion 122 of the primary winding 12 and wound on the frame 202, and an outer circumferential core 203. A magnetic circuit of the ignition coil 100 is formed of the cores 10 and 203.

The igniter 30 shown in FIG. 1 is connected with a power source (not shown) and an electronic control unit (not shown) through a connection terminal 51 accommodated in the connecter 50. In response to an ignition signal transmitted from the control unit, the igniter 30 intermittently applies a source voltage of the power source to the primary coil 1, the coil 1 generates a high voltage and applies this high voltage to the secondary coil 20 at a predetermined ignition timing due to the mutual induction between the coils 1 and 20. A high voltage generated in the coil 20 is applied to a spark plug (not shown) through a winding end 204 of the winding 202, a high voltage line 21, a high voltage terminal 22, a noise suppression resistor 23 and a connection spring 24.

Open space not occupied with the above-described members within the housing 40 is packed with an insulating material member 410 formed of thermoplastic resin, epoxy resin or the like.

The center core 10 is formed of a compressed powder core. This compressed powder core is obtained by packing particles of magnetic powder, formed substantially in a spherical shape according to the water atomizing method, into two divided dies, and compressing and molding the magnetic powder with the divided dies. The magnetic powder is formed of particles of a magnetic metal such as iron, cobalt or nickel or is formed of particles of an alloy of these magnetic metals.

The compressed powder core forming the center core 10 differs from the conventional laminated core formed by laminating electromagnetic steel sheets such as silicon steel sheets. No edge exists on the outer circumferential surface of the center core 10, so that the whole outer circumferential surface of the center core 10 is smooth or glassy. Therefore, the winding 12 can be directly wound on the body portion formed of the portion 102 and 103.

As shown in FIG. 2, when the center core 10 is formed by using two divided dies, burrs are formed on the outer surface of the center core 10 along dividing trace lines LT which extend along dividing lines between the divided dies. The dividing lines of the divided dies are preset to be symmetric with respect to the center axis Ac1 of the core 10 in the dies. Even when it is tried to remove the burrs formed along the dividing trace lines LT from the core 10, burrs BR sometimes remain on the root 104 of the smaller diameter portion 102.

In this embodiment, to prevent the remaining burrs BR from damaging the winding 12, two divided dies for compressing and molding the magnetic powder to the compressed powder core are shaped such that a specific diagonal line of the rectangle of the collar portion 101 is placed on a contact surface on which the divided dies are in contact with each other. In other words, the divided dies are shaped such that the dividing lines of the divided dies extend along a specific diagonal line of the rectangle of the collar portion 101. In this case, the dividing trace lines LT also extend along the specific diagonal line on the surface of the collar portion 101. Further, the collar portion 101 of the core 10 is disposed in the socket 11 formed in the shape of the rectangle such that a segment of the specific diagonal line on the winding start side is exposed to the opening 112 on the root 104 of the smaller diameter portion 102 while another segment of the specific diagonal line on the winding end side is not exposed to the opening 112 on the root 104. For example, the collar portion 101 is disposed in the socket 11 such that the specific diagonal line on the opened side is located on the winding start side while the specific diagonal line on the closed side is located on the winding end side. Therefore, the dividing trace line LT on the winding start side is exposed to the opening 112 on the root 104 of the smaller diameter portion 102, while the other dividing trace line LT on the winding end side is not exposed to the opening 112 on the root 104. In this case, although the burr BR remaining on the winding start side is exposed to the opening 112, any burr BR remaining on the winding end side is not exposed to the opening 112 but is covered with the side wall 111 of the socket 12.

A specific turn of winding 12 starting from the winding start point $W_{STR}$ is located in the first layer of the winding 12 being directly in contact with the portion 102 and is positioned nearest to the surface of the collar portion 101 among turns of winding 12 in the first layer. Therefore, the specific turn of winding 12 is supported by the side wall 111. Further, the terminal portion 121 of the winding 12 extending from the specific turn of winding 12 is caught by the winding start catching portion 12 of the socket 11. Therefore, the terminal portion 121 of the winding 12 fixedly supported by the side wall 111 of the socket 11 in the range from the catching portion 113 to the winding start point $W_{STR}$. In this case, the specific turn of winding 12 is fixedly supported by the terminal portion 121 fixedly supported by the socket 11, and this specific turn of winding 12 fixedly supports the other turns of winding 12 on the winding start side. Therefore, there is no probability that the turns of winding 12 formed in the regular winding shape is deformed on the winding start side, and the burr BR exposed to the opening do not cut any insulator of these turns of winding 12 on the winding start side.

Further, the burr BR remaining on the root 104 of the smaller diameter portion 102 on the winding end side is not exposed to the opening 112 but is covered with the side wall 111. Therefore, even when one turn of winding 12 formed in the regular winding shape is deformed on the winding end side so as to approach the burr BR, there is no probability that the burr BR remaining on the root 104 causes a damage in the winding 12 on the winding end side.

Figure 4:
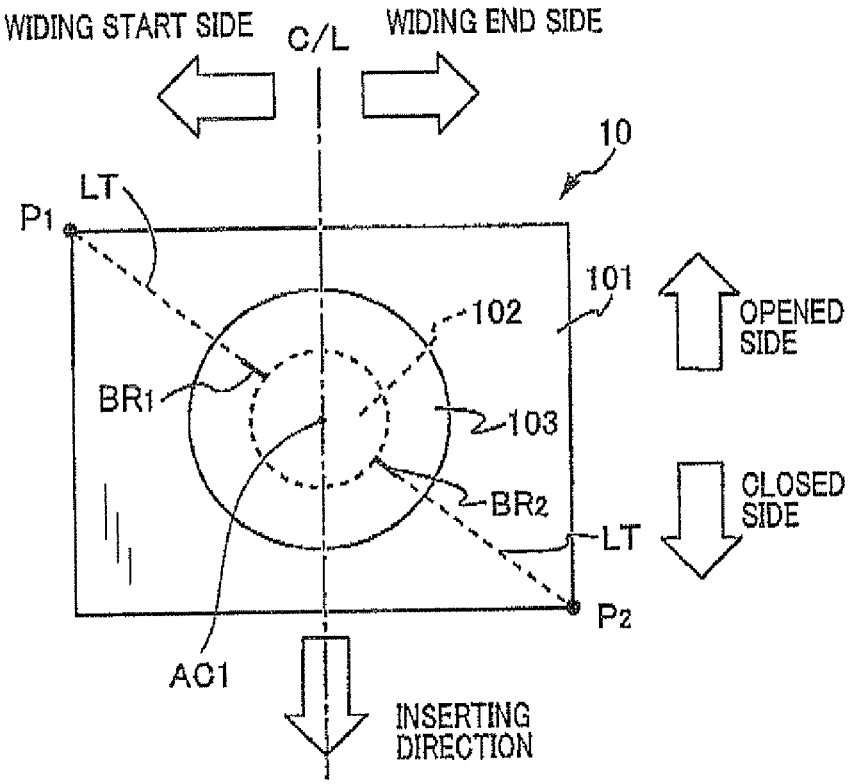
FIG. 4 is a bottom view of a center core of the primary coil according to the first embodiment.

The center core 10 according to this embodiment will be described in more detail with reference to FIG. 4 and FIG. 5. FIG. 4 is a bottom view of the center core 10 with burrs remaining after burr removal, and FIG. 5 is a side view of the center core 10.

The center core 10 is formed of a compressed powder core produced from particles of magnetic powder. Each particle of the magnetic powder is formed substantially in a spherical shape according to the water atomizing method. The particles of magnetic powder are annealed to remove distortion from the particles and are coated with an insulator made of a component of heat resisting organic resin such as silicon resin to insulate the particles of the magnetic powder from one another. These particles of the magnetic powder are compressed and molded by two divided dies.

The divided dies are divided along a specific direction to the dies. Therefore, as shown in FIG. 4, the dividing trace lines LT formed along the dividing lines of the divided dies extend along a specific diagonal line of a rectangle which is formed by projecting the collar portion 101 on a plane perpendicular to the center axis Ac1. The specific diagonal line connects a vertex P1 and a vertex P2 of the rectangle. The collar portion 101 is located in the socket 11 such that the vertex P1 is positioned toward the winding start side from a center line C/L of the socket 11 and is positioned on the opened side while the vertex P2 is positioned toward the winding end side from the center line C/L and is positioned on the closed side.

Figure 5:
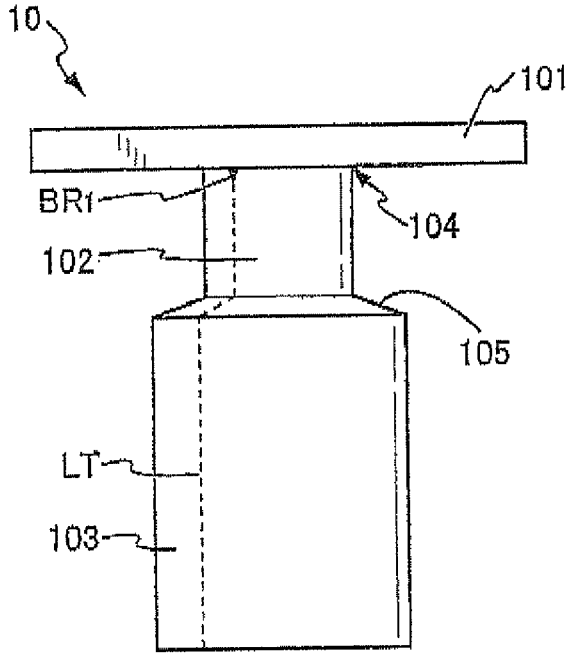
FIG. 5 is a side view of the center core.

Further, as shown in FIG. 4 and FIG. 5, a burr BR1 sometimes remains on the root 104 of the smaller diameter portion 102 along the specific diagonal line (or one dividing trace lines LT) on the winding start side, and a burr BR2 sometimes remains on the root 104 along the specific diagonal line (or the other dividing trace lines LT) on the winding end side.

Figure 6A:
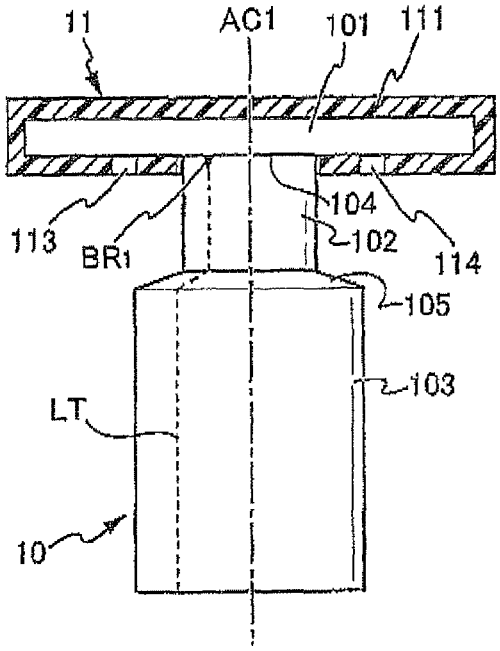
FIG. 6A is a side view of the center core fixed to the socket.
Figure 6B:
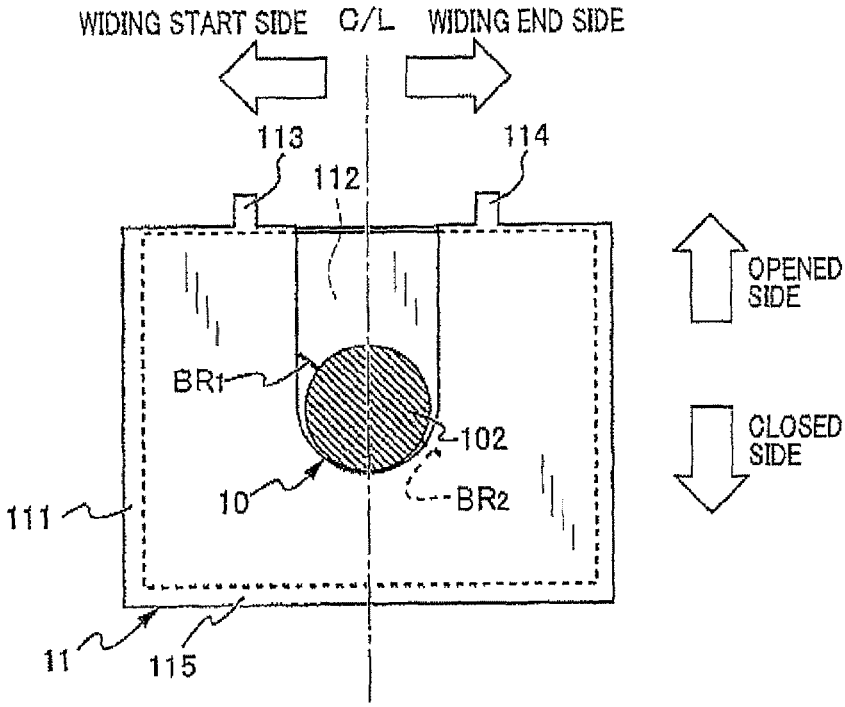
FIG. 6B is a bottom view, partially in cross-section, of the center core shown in FIG. 6A.
Figure 7A:
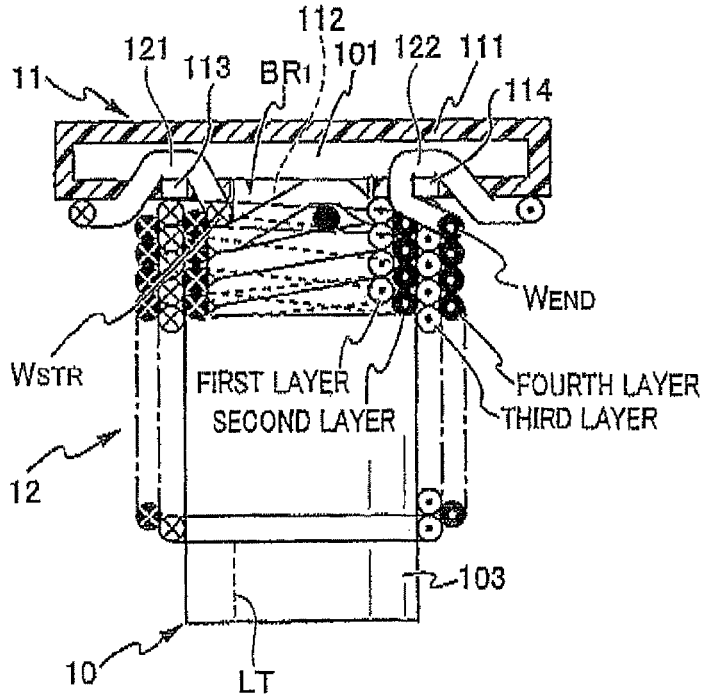
FIG. 7A is a side view, partially in cross-section, schematically showing the center core wound by a winding.

The primary coil 1 according to this embodiment will be described in more detail with reference to drawings. FIG. 6A is a side view of the center core 10 fixed to the socket 11, and FIG. 6B is a bottom view, partially in cross-section, of the center core 10 shown in FIG. 6A. FIG. 7A is a side view, partially in cross-section, schematically showing the center core 10 wound by the winding 12 and the socket 11, and FIG. 7B is a bottom view, partially in cross-section, of the center core 10 shown in FIG. 7A.

As shown in FIG. 6A and FIG. 6B, when the collar portion 101 of the center core 10 is inserted into the socket 11 such that a first segment of the specific diagonal line connected with the vertex P1 is placed on the opened side and the winding start side of the smaller diameter portion 102 while a second segment of the specific diagonal line connected with the vertex P2 is positioned on the closed side and the winding end side of the smaller diameter portion 102, the burr BR1 formed on the first segment of the specific diagonal line is exposed to the opening 112, while the burr BR2 formed on the second segment of the specific diagonal line is not exposed to the opening 112 but is covered with side wall 111 of the socket 11.

Figure 7B:
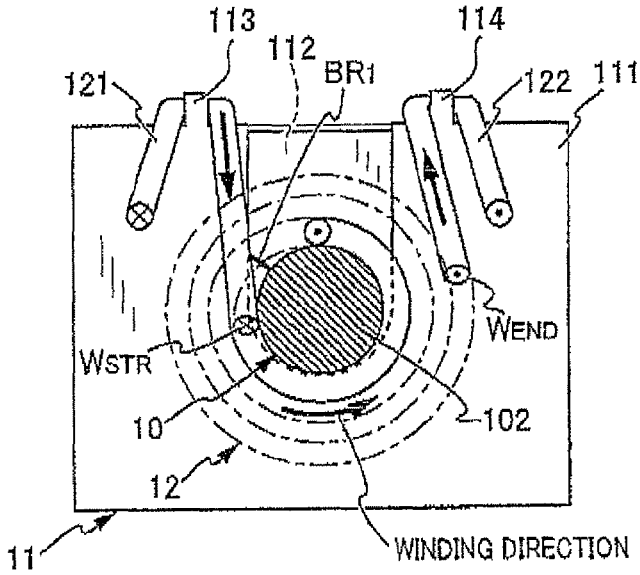
FIG. 7B is a bottom view, partially in cross-section, of the center core shown in FIG. 7A.

As shown in FIG. 7A and FIG. 7B, the terminal portion 121 of the winding 12 starting from the winding start point $W_{STR}$ of the first layer is caught by the catching portion 113 located on the winding start side. Therefore, the terminal portion 121 from the position of the catching portion 113 to the winding start point $W_{STR}$ is fixedly supported by the side wall 111 of the socket 11. Because a specific turn of winding 12 located nearest to the surface of the collar portion 101 among the turns of the winding 12 of the first layer is fixedly supported by both the terminal portion 121 fixedly supported and the side wall 111 of the collar portion 101, there is no probability that a portion of the specific turn of winding 12 on the winding start side is bent toward the collar portion 101 without keeping the winding 12 in the regular winding shape. That is, even when the burr BR1 is exposed to the opening 112 on the winding start side, there is no probability that the winding 12 placed on the winding start side is brought into contact with the burr BR1 so as to be damaged by the burr BR1.

Further, because the burr BR2 remaining on the winding end side is not exposed to the opening 112 but is covered with the side wall 111, there is no probability that the winding 12 deformed at a position near the burr BR2 on the winding end side is damaged by the burr BR2.

Accordingly, because the collar portion 101 of the center core 10 is disposed in the socket 11 such that the root 104 of the smaller diameter portion 102 is exposed to the opening 112 on one segment of the specific diagonal line positioned on the winding start side while the root 104 is substantially covered with the side wall 111 on the other segment of the specific diagonal line positioned on the winding end side, the ignition coil 100 can reliably apply a high voltage to a spark plug while the primary coil 1 of the coil 100 reduces the incidence rate of short circuits when the center core 10 of the coil 1 is formed by compressing and molding magnetic powder.

Figure 8A:
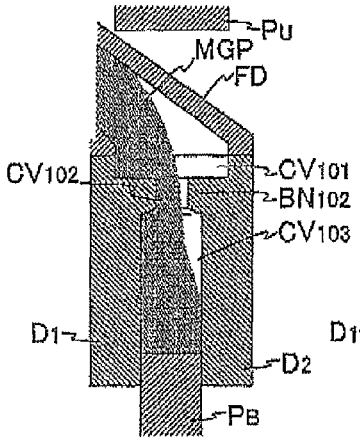
FIG. 8A is a longitudinal sectional view of two diving dies according to the first embodiment.
Figure 8B:
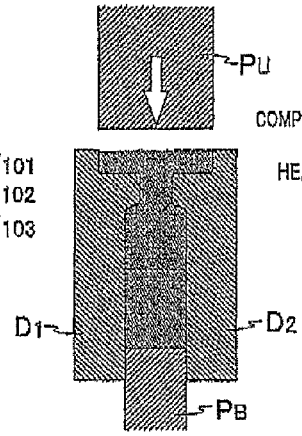
FIG. 8B is a longitudinal sectional view of the diving dies packed with magnetic powder.
Figure 8C:
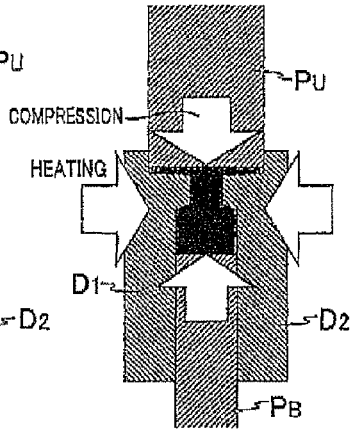
FIG. 8C is a longitudinal sectional view of the diving dies holding the magnetic powder compressed and molded.
Figure 8E:
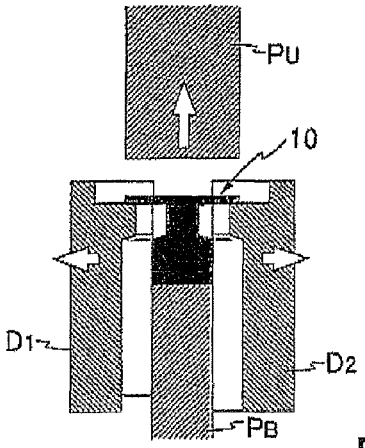
FIG. 8E is a longitudinal sectional view of the diving dies from which the magnetic powder is released.
Figure 8F:
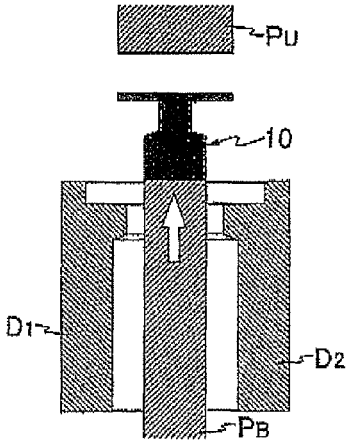
FIG. 8F is a longitudinal sectional view of the diving dies from which the magnetic powder is taken out.
Figure 8D:
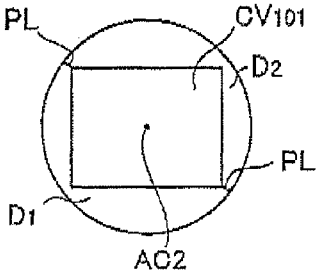
FIG. 8D is a top view of the diving dies.

A method of manufacturing the center core 10 will be described with reference to FIG. 8A to FIG. 8F. FIG. 8A is a longitudinal sectional view of two diving dies according to the first embodiment, FIG. 8B is a longitudinal sectional view of the diving dies packed with the magnetic powder, and FIG. 8C is a longitudinal sectional view of the diving dies holding the magnetic powder compressed and molded. FIG. 8D is a top view of the diving dies. FIG. 8E is a longitudinal sectional view of the diving dies from which the compressed and molded magnetic powder is released, and FIG. 8F is a longitudinal sectional view of the diving dies from which the compressed and molded magnetic powder is taken out.

As shown in FIG. 8A, two divided dies D1 and D2 facing each other forms a first space $CV_{101}$, formed in the shape of the collar portion 101, a second space $CV_{102}$, formed in the shape of the smaller diameter portion 102, and a third space $CV_{103}$ formed in the shape of both the diameter changing portion 105 and the larger diameter portion 103. The dies D1 and D2 have a diameter shortening portion $BN_{102}$, formed substantially in a columnar shape, to set a circumferential wall surrounding the space $CV_{102}$ in a smaller diameter, as compared with walls of the spaces $CV_{101}$ and $CV_{103}$. A lower punch PL is slidably inserted into the space $CV_{103}$ from the lower side, so that the lower side of the dies D1 and D2 is closed.

The inner walls of the dies D1 and D2 may be coated with lubricant. In this case, magnetic powder compressed and molded in the dies D1 and D2 can be easily released from the dies D1 and D2.

As shown in FIG. 8A, particles of magnetic powder MCP, formed substantially in a spherical shape according to a well-known method such as a water atomizing method, are supplied into the spaces $CV_{101}$ to $CV_{103}$ of the dies D1 and D2. Each particle of the magnetic powder MGP is coated with a well-known insulating material such as silicon resin, phosphate glass or an insulating organic material to insulate the particles of the magnetic powder MGP from one another. The magnetic powder MGP may be mixed with mold releasing agent. In this case, magnetic powder compressed and molded in the dies D1 and D2 can be easily released from the dies D1 and D2. Then, as shown in FIG. 8B, the spaces $CV_{101}$ to $CV_{103}$ of the dies D1 and D2 are packed with the magnetic powder MGP set at a predetermined volume. Then, as shown in FIG. 8C, the magnetic powder MGP supported by the lower punch PL is compressed by an upper punch PU at a warm condition. Therefore, the warm compression molding is performed for the magnetic powder MGP, and the magnetic powder MGP is shaped into the compressed powder core 10. As shown in FIG. 8D, the divided dies D1 and D2 are rotationally symmetric with respect to a center axis Ac2 of the dies D1 and D2. The divided dies D1 and D2 are formed such that two dividing lines PL between the divided dies D1 and D2 extend along one diagonal line of a rectangle which is formed by projecting the space $CV_{101}$ on a plane perpendicular to the center axis Ac2. Therefore, lines LT of the dividing trace are formed on the outer surface of the compressed powder core 10 along the dividing lines such that the lines LT extend along one diagonal line of a rectangle, which is formed by projecting the collar portion 101 on the center axis Ac1, while surrounding the core 10. Then, as shown in FIG. 8E, the dies D1 and D2 are moved in opposite directions to be separated from each other. Therefore, the compressed powder core 10 is released from the dies D1 and D2. Then, as shown in FIG. 8F, the compressed powder core 10 is taken out from the dies D1 and D2.

Figure 9A:
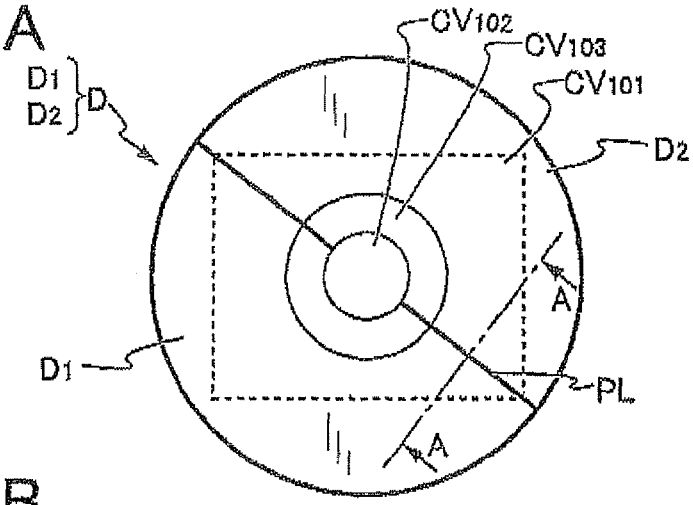
FIG. 9A is a bottom view of the divided dies.
Figure 9B:
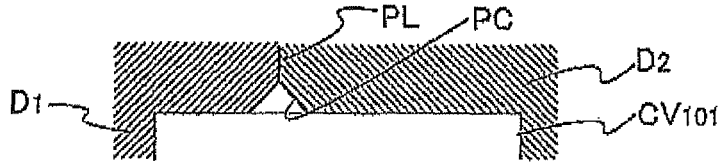
FIG. 9B is a sectional view taken substantially along line A-A of FIG. 9A.
Figure 10A:
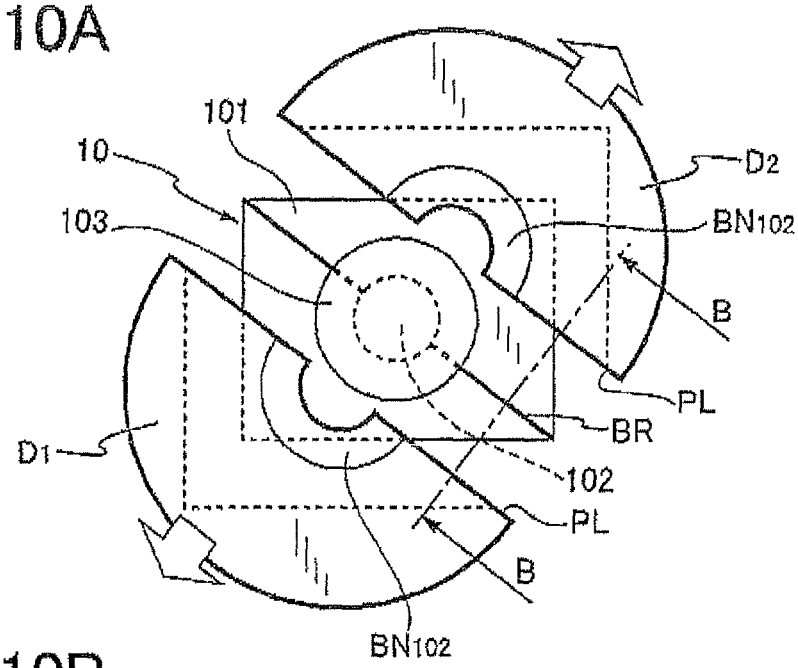
FIG. 10A is a bottom view of the divided dies released from the core.

Features of the divided dies D1 and D2 for compressing and molding the magnetic powder MGP to the center core 10 will be described in detail with reference to FIG. 9A to FIG. 10B. FIG. 9A is a bottom view of the divided dies D1 and D2 for forming the center core 10, and FIG. 9B is a sectional view taken substantially along line A-A of FIG. 9A. FIG. 10A is a bottom view of the divided dies D1 and D2 released from the center core 10, and FIG. 10B is a sectional view taken substantially along line B-B of FIG. 10A.

As shown in FIG. 9A, a core molding die D formed in the shape of the center core 10 is divided into the divided dies D1 and D2 having the same shape such that dividing lines PL of the divided dies D1 and D2 extend along one diagonal line of the rectangle formed by the first space $CV_{101}$. Further, as shown in FIG. 9B, chamfered faces Pc are formed on contact surfaces of the divided dies D1 and D2 along the dividing lines PL to prevent the divided dies D1 and D2 from being broken.

After the magnetic powder MGP is compressed and molded to the center core 10 in the dies D1 and D2, as shown in FIG. 10A, the dies D1 and D2 are moved in opposite directions perpendicular to the contact surface of the dies D1 and 02, and the dies D1 and D1 are released from the core 10. In this movement of the dies D1 and D2, the length of the collar portion 101, overlapping with each die, in the direction parallel to the dividing line PL is gradually shortened. Therefore, the friction between the outer circumferential surface of the collar portion 101 and the inner circumferential surface of the dies D1 and D2 can be reduced, and the friction between the side surface of the collar portion 101 and the end surface of the diameter shortening portion $BN_{102}$ can be reduced. Accordingly, the center core 10 can be smoothly released from the dies D1 and D2.

Figure 10B:
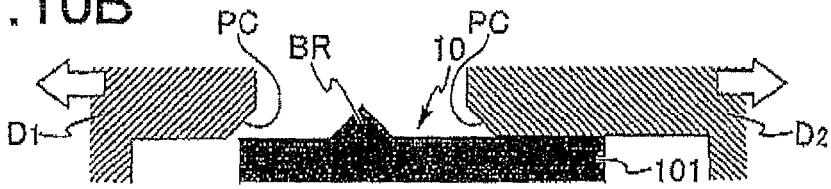
FIG. 10B is a sectional view taken substantially along line B-B of FIG. 10A.

Further, as shown in FIG. 10B, the magnetic powder MGP is packed into the space, which extend along the chamfered planes Pc of the divided dies D1 and D2, to form burrs BR. These burrs BR are located on the outer surface of the center core 10 along the dividing trace lines so as to surround the core 10.

Figure 11A:
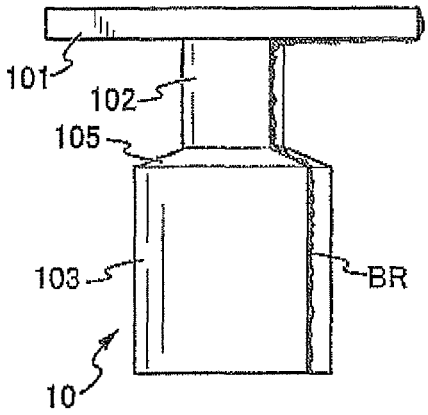
FIG. 11A is a side view of the center core with burrs.
Figure 11B:
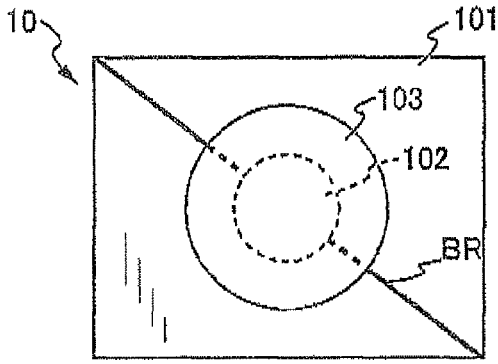
FIG. 11B is a bottom view of the center core shown FIG. 11A.
Figure 12A:
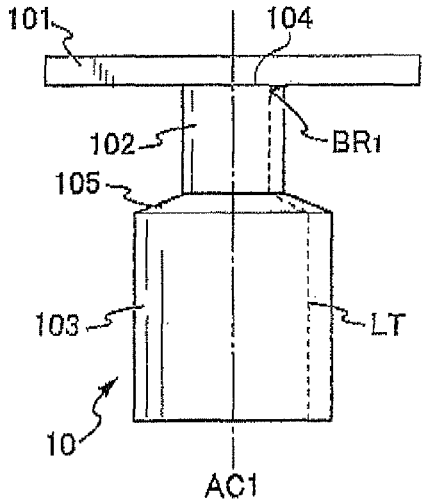
FIG. 12A is a side view of the center core with burrs remaining after burr removal.
Figure 12B:
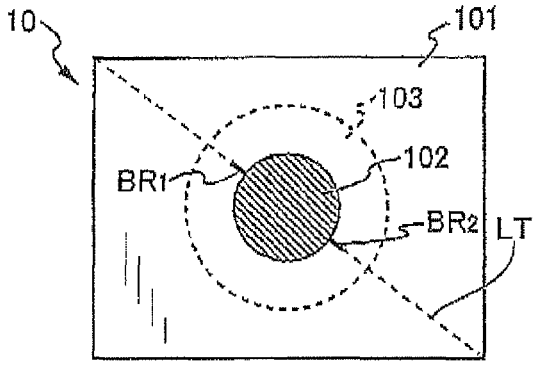
FIG. 12B is a bottom view of the core shown in FIG. 12A.

FIG. 11A is a side view of the center core 10 with burrs BR formed during the molding of the core 10, and FIG. 11B is a bottom view of the center core 10 shown in FIG. 11A. FIG. 12A is aside view of the center core 10 with burrs remaining after burr removal, and FIG. 12B is a bottom view of the core 10 shown in FIG. 12A. As shown in FIG. 11A and FIG. 11B, burrs BR are formed on the surfaces of the portions 101, 102, 103 and 105. Especially, the burrs BR formed on the surface of the collar portion 101 extend along the specific diagonal line of the rectangle of the portion 101. As shown in FIG. 12A and FIG. 12B, when it is tried to remove these burrs BR, formed on the portions 101, 102, 103 and 105, by using a well-known method such as buffing or blasting, burrs BR formed on the surfaces of the portions 102, 103 and 105 and burrs BR formed on the flattened surfaces of the collar portion 101 can be easily removed. However, it is difficult to perfectly remove the burrs BR formed on the root 104 of the portion 102. Therefore, a burr BR1 and a burr BR2 extending along the specific diagonal line slightly remain on the root 104 to be symmetric to each other with respect to the center axis Ac1.

In this embodiment, the collar portion 101 of the core 10 is disposed in the socket 11 such that a segment of the specific diagonal line, on which the burr BR1 is formed, is located on both the winding start side and the opened side of the smaller diameter portion 102 while another segment of the specific diagonal line, on which the burr BR2 is formed, is located on both the winding end side and the closed side of the diameter smaller portion 102 (see FIG. 4). Therefore, the burr BR1 remaining on the winding start side is exposed to the opening 112, while the burr BR2 remaining on the winding end side is not exposed to the opening 112 but is covered with side wall 111. Because the winding 12 located on the winding start side is hardly deformed, the burr BR1 remaining on the winding start side does not damage the winding 12 located on the winding start side. Further, because the burr BR2 remaining on the winding end side is not exposed to the opening 112, the burr BR2 does not damage the winding 12 deformed on the winding end side.

Accordingly, the ignition coil 100 can have the primary coil 1 which reduces the incidence rate of short circuits.

Further, even when burrs formed on the collar portion 101 are not removed from the core 10, the burrs of the collar portion 101 put into the socket 11 are covered with the side walls 111 of the socket 11. Therefore, the burrs formed on the collar portion 101 do not damage the winding 12. Accordingly, the removal of the burrs from the core 10 can be simplified.

Figure 13A:
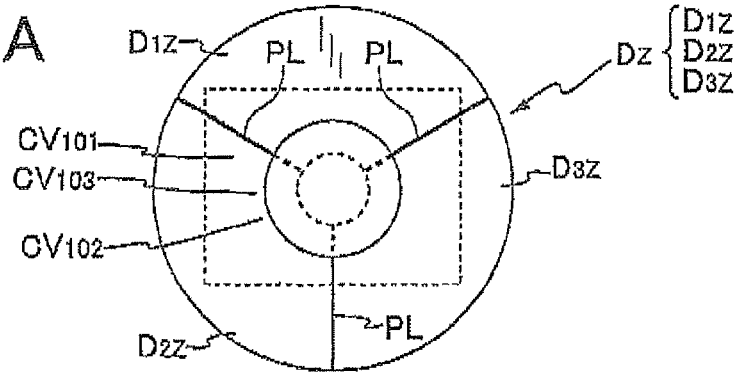
FIG. 13A is a bottom view of three divided dies in first, second and third comparative examples.
Figure 13B:
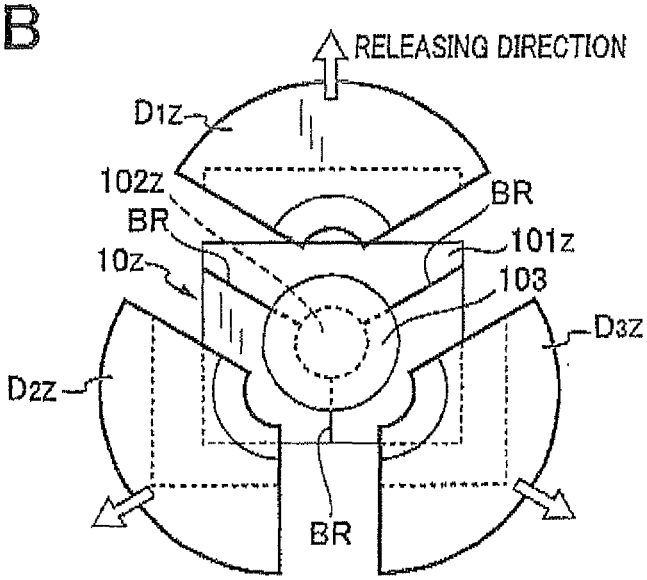
FIG. 13B is a bottom view of the divided dies, released from the center core, in the comparative examples.
Figure 14A:
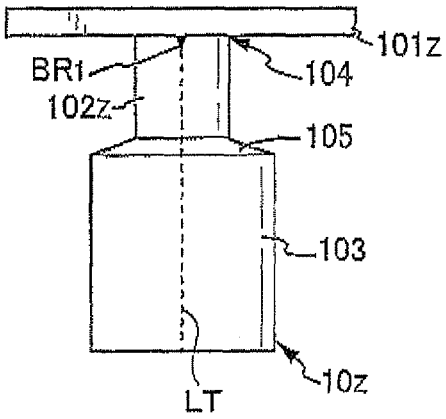
FIG. 14A is a side view of a center core with burrs, remaining after burr removal, in the comparative examples.
Figure 14B:
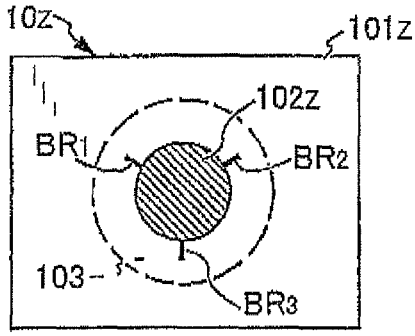
FIG. 14B is a bottom view of the core shown in FIG. 14A.

Comparative examples in which a center core of the primary coil 1 is formed by using three divided dies will be described with reference to FIG. 13A to FIG. 14B. FIG. 13A is a bottom view of three divided dies in first, second and third comparative examples, and FIG. 13B is a bottom view of the divided dies, released from the center core, in the comparative examples. FIG. 14A is a side view of a center core with burrs, remaining after burr removal, in the comparative examples, and FIG. 14B is a bottom view of the core shown in FIG. 14A.

As shown in FIG. 13A, a core molding die D formed in the shape of a center core 10z is divided into three divided dies $D_{1Z}$, $D_{2Z}$ and $D_{3Z}$, and magnetic powder is compressed and molded in the divided dies $D_{1Z}$, $D_{2Z}$ and $D_{3Z}$ to form the eenter core 10z. In this molding, as shown in FIG. 13B, the divided die $D_{1Z}$, forming one longer side of a collar portion 101z of the core 10z is moved in a releasing direction perpendicular to the longer side of the portion 101z, and the die $D_{1Z}$ is released from the core 10z. Further, the other divided dies $D_{2Z}$ and $D_{3Z}$ are, respectively, moved in directions making an angle of 120 degrees to the releasing direction, and the dies $D_{2Z}$ and $D_{3Z}$ are release from the core 10z. Therefore, burrs BR are inevitably formed on three trace lines of the core 10z extending along three dividing lines of the divided dies $D_{1Z}$, $D_{2Z}$ and $D_{3Z}$. As shown in FIG. 14A and FIG. 14B, when it is tried to remove these burrs BR from the core 10z, a burr BR1, a burr BR2 and a burr BR3 remain on a root 104 of a smaller diameter portion 102z from which the collar portion 101z extends perpendicularly to the portion 102z.

Figure 15A:
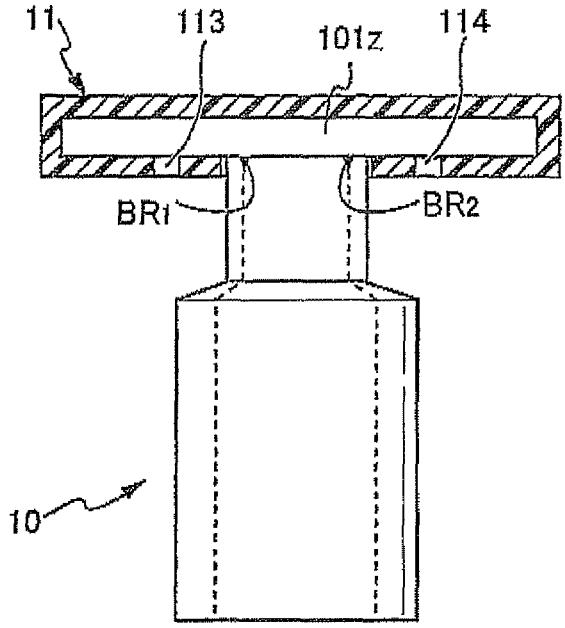
FIG. 15A is a side view of the center core fixed to the socket in the first comparative example.
Figure 15B:
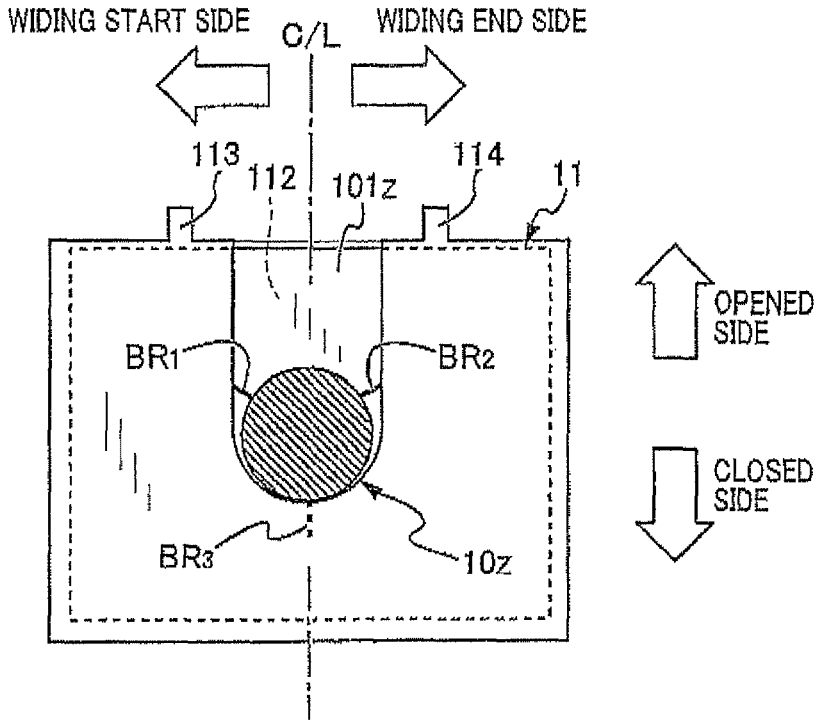
FIG. 15B is a bottom view, partially in cross-section, of the center core shown in FIG. 15A.
Figure 16A:
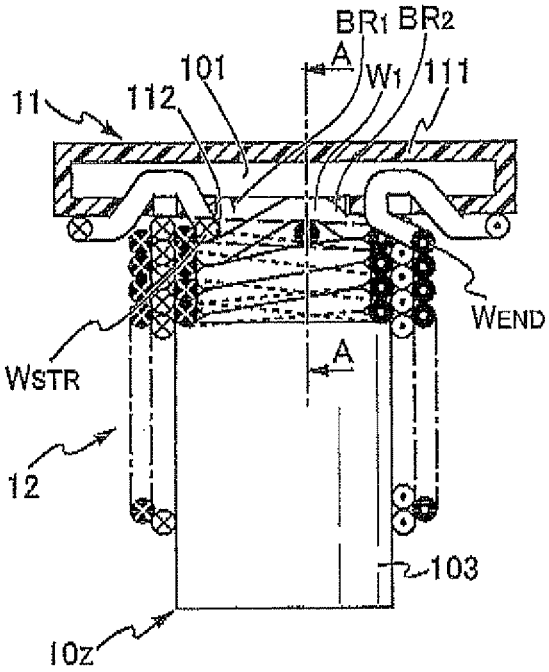
FIG. 16A is a side view, partially in cross-section, schematically showing the center core wound by the winding in the first comparative example.
Figure 16B:
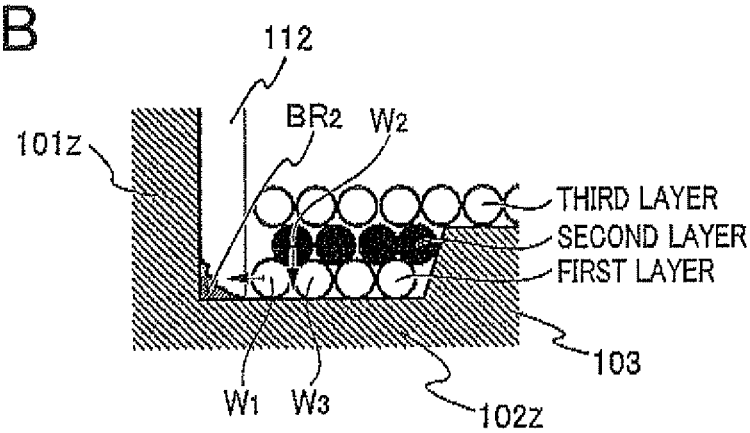
FIG. 16B is a sectional view of the winding, keeping the winding shape on the center core, taken substantially along line A-A of FIG. 16A.
Figure 16C:
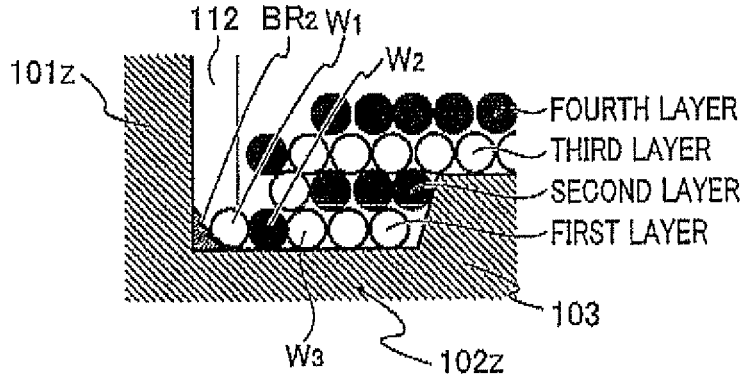
FIG. 16C is a sectional view of the winding, not keeping the winding shape on, the center core, taken substantially along line A-A of FIG. 16A.

Problems caused in the first comparative example will be described with reference to FIG. 15A to FIG. 16C. FIG. 15A is a side view of the center core fixed to the socket 11 in the first comparative example, and FIG. 15B is a bottom view, partially in cross-section, of the center core shown in FIG. 15A. FIG. 16A is a side view, partially in cross-section, schematically showing the center core wound by the winding 12 in the first comparative example, FIG. 16B is a sectional view of the winding, keeping the regular winding shape on the center core, taken substantially along line A-A of FIG. 16A, and FIG. 16C is a sectional view of the winding, not keeping the regular winding shape on the center core, taken substantially along line A-A of FIG. 16A.

In the first comparative example, as shown in FIG. 15A and FIG. 15B, the center core 10z having the burr BR1, BR2 and BR3 is placed into the socket 11 so as to place the burr BR1 on the winding start side, to place the burr BR2 on the winding end side and to place the burr BR3 at the bottom of the opening 112 on the closed side. The burr BR1 is placed to be symmetric to the burr BR2 with respect to the center line C/L of the socket 11. In this case, although the burr BR3 is covered with the side wall 111 of the socket 11, the burr BR1 and the burr BR2 are exposed to the opening 112.

When the winding 12 is wound on the center core 10z, the winding 12 is not brought into contact with the burr BR1 or the burr BR3, as described above according to the embodiment. However, as shown in FIG. 16A, a first turn W1 of winding 12 nearest to the collar portion 101z in the first layer is sometimes brought into contact with the burr BR2 exposed to the opening 112. This contact will be described in detail. The catching portion 114 located on the winding end side catches the terminal portion 122 of the winding 12 extending from the winding end point $W_{END}$ of the fourth layer to fixedly hold the turn of winding 12 nearest to the collar portion 101z on the fourth layer. Therefore, the first turn W1 of winding 12 is comparatively movable toward the portion 101z. Further, a specific portion of the winding 12 in the first turn W1, placed to be nearest to the burr BR2, is not supported by the side wall 111 of the portion 101z but is exposed to the opening 112. Therefore, the specific portion of the winding 12 in the first turn W1 is movable toward portion 101z. As shown in FIG. 16B, when a second turn W2 of the winding 12, located in the second layer and is placed on both the first turn W1 of winding 12 and a third turn W3 of winding 12 adjacent to the first turn W3 of winding 12, is pushed toward the winding 12 of the first layer, no side wall 111 fixedly supports the specific portion of the winding 12 in the first turn W1. Therefore, as shown in FIG. 16C, the specific portion of the winding 12 in the first turn W1 is moved toward the burr BR2 while the second turn W2 of the winding 12 in the second layer is pushed into the space between the first turn W1 of winding 12 and the third turn W3 of winding 12 in the first layer. In this case, the specific portion of the winding 12 in the first turn W1 is sometimes bent to be brought into contact with the burr BR2. Therefore, the primary coil 1 sometimes causes a short circuit.

Figure 17A:
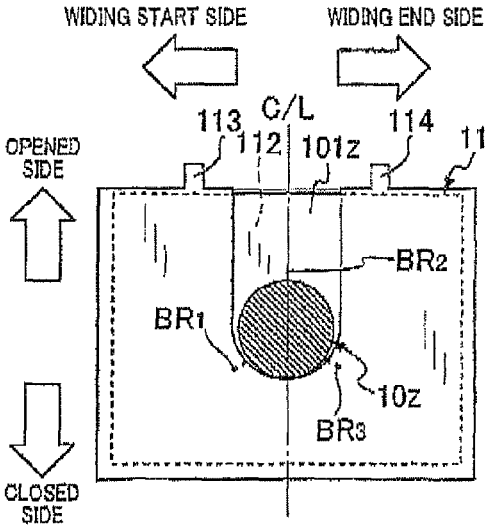
FIG. 17A is a bottom view, partially in cross-section, of the center core fixed to the socket in the second comparative example.
Figure 17B:
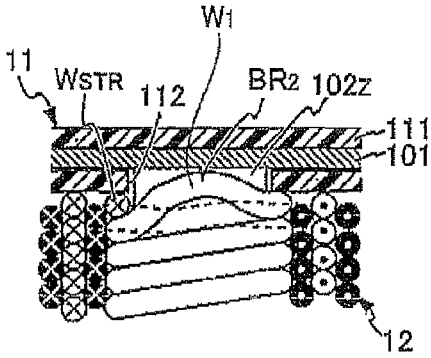
FIG. 17B is a partial side view, partially in cross-section, schematically showing the center core wound by the winding in the second comparative example.

Problems caused in the second comparative example will be described with reference to FIG. 17A and FIG. 17B. FIG. 17A is a bottom view, partially in cross-section, of the center core 10z fixed to the socket 11 in the second comparative example, and FIG. 17B is a partial side view, partially in cross-section, schematically showing the center core wound by the winding 12 in the second comparative example.

In the second comparative example, as shown in FIG. 17A, the center core 10z having the burrs BR1, BR2 and BR3 is placed into the socket 11 so as to cover the burr BR1 with the side wall 111 on the winding start side, to cover the burr BR3 with the side wall 111 on the winding end side and to expose the burr BR2 to the opening 112. The burr BR1 is placed to be symmetric to the burr BR3 with respect to the center line C/L of the socket 11. In this case, none of the burr BR1 and the burr BR3 are exposed to the opening 112.

When the winding 12 is wound on the center core 10z, the winding 12 is not brought into contact with the burr BR1 or the burr BR3. However, the winding 12 is sometimes brought into contact with the burr BR2 exposed to the opening 112. More specifically, as shown in FIG. 17B, a first turn W1 of the winding 12 located nearest to the collar portion 101z in the first layer can be easily moved, and a specific portion of the winding 12 in the first turn W1, placed to be nearest to the burr BR2, is not supported by the side wall 111 of the portion 101z but is exposed to the opening 112. Therefore, the specific portion of the winding 12 in the specific turn W1 is sometimes bent to be brought into contact with the burr BR2. In this case, the primary coil 1 sometimes causes a short circuit.

Figure 18A:
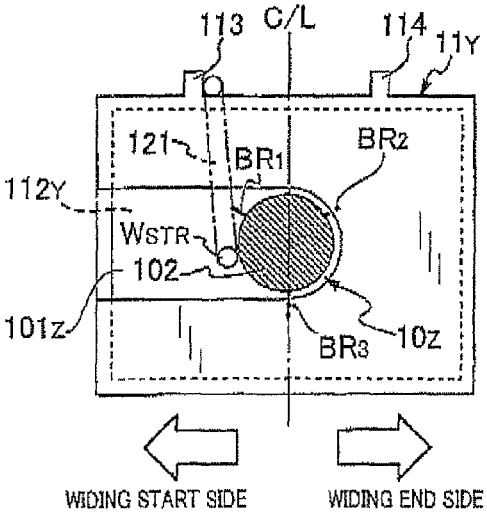
FIG. 18A is a bottom view, partially in cross-section, of the center core fixed to the socket in the third comparative example.
Figure 18B:
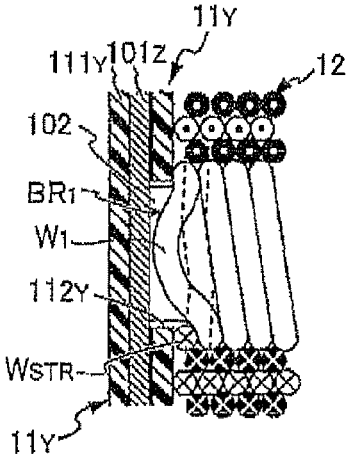
FIG. 18B is a partial side view, partially in cross-section, schematically showing the center core wound by the winding in the third comparative example.

Problems caused in the third comparative example will be described with reference to FIG. 18A and FIG. 18B. FIG. 18A is a bottom view, partially in cross-section, of the center core 10z fixed to the socket 11 in the third comparative example, and FIG. 18B is a partial side view, partially in cross-section, schematically showing the center core wound by the winding 12 in the third comparative example.

In the third comparative example, as shown in FIG. 18A, the center core 10z having the burrs BR1, BR2 and BR3 is inserted into a connector socket $\mathbf{11}_Y$. This socket $\mathbf{11}_Y$ differs from the socket 11 in that the catching portions 113 and 114 are disposed on a specific end of the side wall 111, connecting the open end and the bottom wall 115. The catching portion 113 is placed on the winding start side with respect to the center line C/L, and the catching portion 114 is placed on the winding end side with respect to the center line C/L.

The center core 10z is disposed in the socket $\mathbf{11}_Y$ so as to place the burr BR1 at a position near the catching portion 113, to place the burr BR2 at a position near the catching portion 114, and to place the burr BR3 at a position furthest from the catching portions 113 and 114. In this case, none of the burr BR2 and the burr BR3 are exposed to the opening 112, but the burr BR1 is exposed to the opening 112.

When the winding 12 is wound on the center core 10*z*, the winding 12 is not brought into contact with the burr BR2 or the burr BR3. However, the winding 12 is sometimes brought into contact with the burr BR1. More specifically, as shown in FIG. 18A and FIG. 18B, the winding start end $W_{STR}$ is inevitably placed in the opening 112. Therefore, the winding start terminal portion 121 of the winding 12 extending from the point $W_{STR}$ is not supported by a side wall $\mathbf{111}_Y$ of the socket $\mathbf{11}_Y$ in the opening 112. Therefore, the terminal portion 121 is sometimes bent to be brought into contact with the burr BR1. In this case, the primary coil 1 sometimes causes a short circuit.

As described above, in the comparative examples in which the center core 10*z* of the primary coil 1 is formed by using three divided dies, even when the positional relation between the burr BR1, BR2 and BR3 formed on the center core 10*z* and the socket 11 is changed or the positional relation between the catching port ions 113 and 114 and the opening 112 is changed, it is difficult to prevent the winding 12 from being in contact with a burr exposed to the opening 112, and the primary coil 1 sometimes causes a short circuit.

In this embodiment, the collar portion 101 of the center core 10 has the rectangular surface forming the rectangle. However, the collar portion 101 may have a surface forming a quadrilateral on a plane perpendicular to the center axis Ac1 of the core 10.

Second Embodiment

Figure 19A:
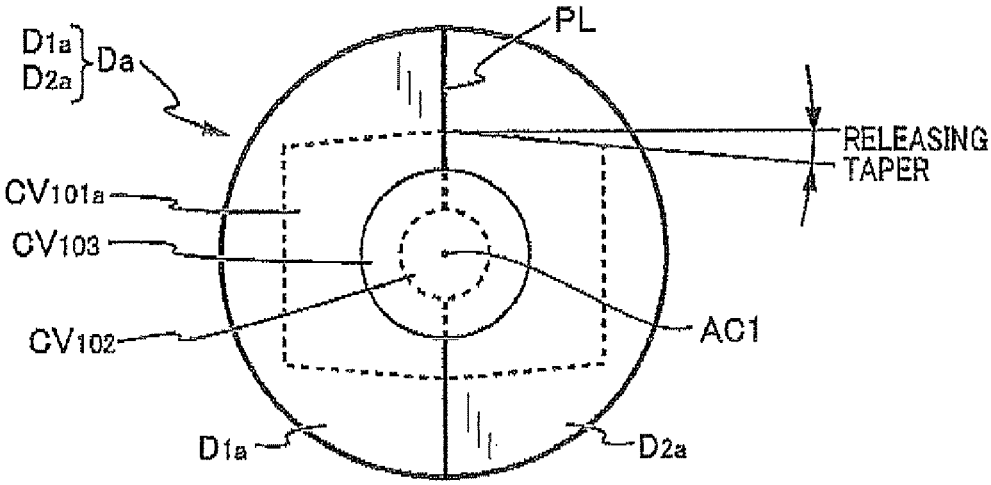
FIG. 19A is a bottom view of two divided dies according to the second embodiment of the present invention.
Figure 19B:
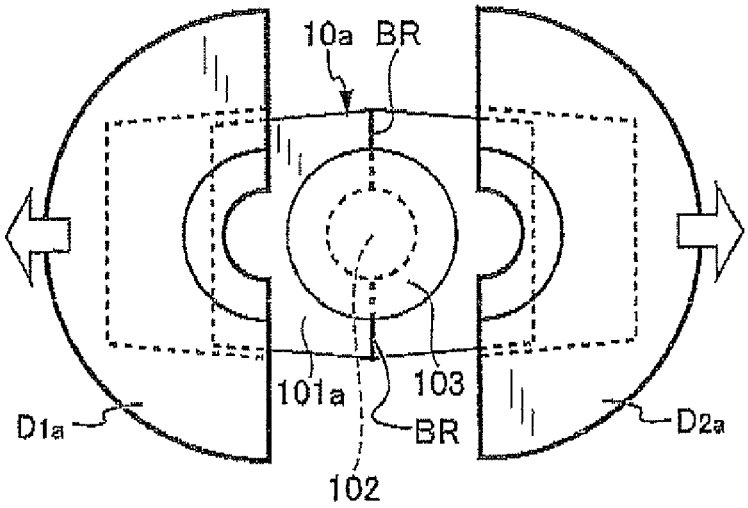
FIG. 19B is a bottom view of the divided dies released from the core.
Figure 20:
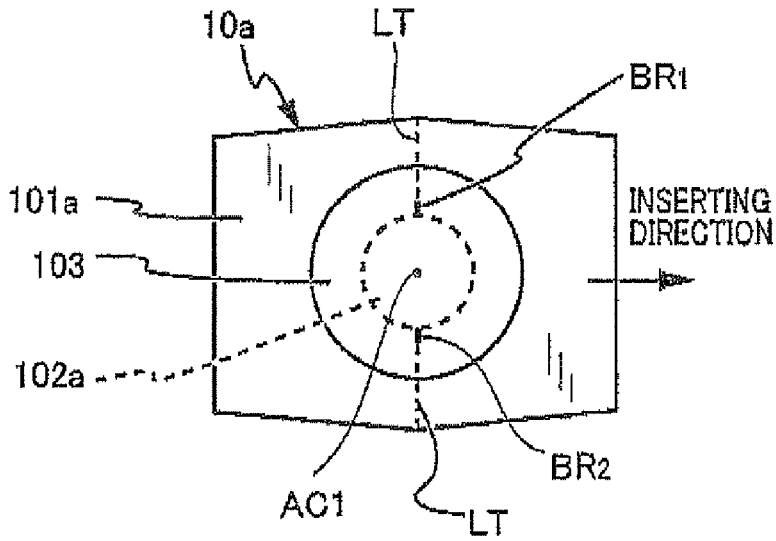
FIG. 20 is a bottom view of the center core with burrs, remaining after burr removal, formed according to the second embodiment.
Figure 21:
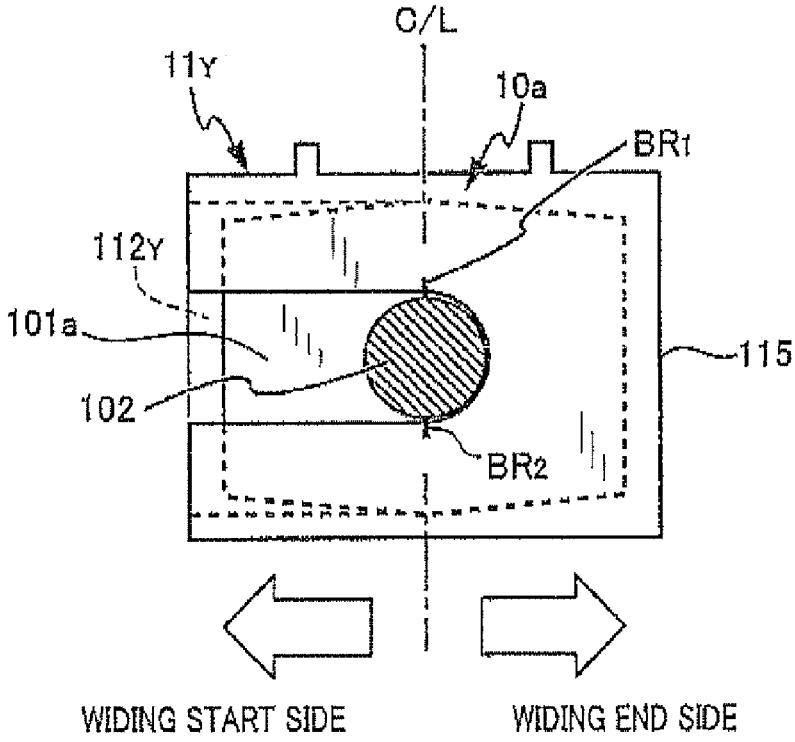
FIG. 21 is a bottom view, partially in cross-section, of the center core fixed to a connector socket according to the second embodiment.

FIG. 19A is a bottom view of two divided dies for forming a center core according to the second embodiment, and FIG. 19B is a bottom view of the divided dies released from the core. FIG. 20 is a bottom view of the center core with burrs, remaining after burr removal, formed according to the second embodiment. FIG. 21 is a bottom view, partially in cross-section, of the center core fixed to a connector socket according to the second embodiment.

As shown in FIG. 19A and FIG. 19B, a core molding die Da formed in the shape of a center core is divided into two divided dies D1*a* and D2*a* having the same shape. The divided dies D1*a* and D2*a* forms a center core 10*a* composed of a collar portion 101*a* and the portions 102, 103 and 105 by compressing and molding the magnetic powder. The portion 101*a* extends from the end 104 of the smaller diameter portion 102 in outer directions perpendicular to a center axis Ac1 of the core 10*a*. The portion 101*a* has outer surfaces forming substantially a rectangle on a plane perpendicular to the center axis Ac1.

The divided dies D1*a* and D2*a* have dividing lines PL extending along a center line of the rectangle of the collar portion 101*a* of the core 10*a* packed in the dies D1*a* and D2*a*. This center line partitions each of two longer sides of the rectangle of the portion 101*a* into substantially two equal segments. Burrs BR are formed on the core 10*a* along trace lines of the core 10*a* extending along the dividing lines PL.

Each of the dies D1*a* and D2*a* preferably have an inner wall formed in a releasing taper to form the collar portion 101*a* tapered in the shape of the releasing taper. More specifically, the width between the longer sides of the rectangle is gradually shortened as the position of the width recedes from the center line. Therefore, when the dies D1*a* and D2*a* are moved in directions, which are opposite to each other and is perpendicular to the center line (or shorter sides of the portion 101*a*), the dies D1*a* and D2*a* can be easily released from the collar portion 101*a*.

As shown in FIG. 20, the center core 10*a* has a burr BR1 and a burr BR2 remaining after the removal of the burrs BR. These burrs BR1 and BR2 are located on the root 104 of the smaller diameter portion 102 along the trace lines LT. The burr BR1 and the burr BR2 are positioned opposite to each other with respect to the center axis Ac1. The collar portion 101*a* of the core 10*a* is inserted into the socket $\mathbf{11}_Y$ along an inserting direction perpendicular to the center line of the collar portion 101*a*.

As shown in FIG. 21, to place the collar portion 101*a* of the core 10*a* in the socket $\mathbf{11}_Y$, one shorter side of the portion 101*a* is first inserted into the socket $\mathbf{11}_Y$, and the other shorter side of the portion 101*a* is finally inserted into the socket $\mathbf{11}_Y$. Therefore, one shorter side of the portion 101*a* faces the bottom wall 115 of the socket $\mathbf{11}_Y$, while the other shorter side of the portion 101*a* faces the open end of the socket $\mathbf{11}_Y$. The center line is substantially perpendicular to the direction, directed from the open end to the bottom wall 115 of the socket $\mathbf{11}_Y$.

Because the diameter of the smaller diameter portion 102 is substantially equal to the width of the opening $\mathbf{112}_Y$, the burrs BR1 and BR2 closely face the side wall $\mathbf{111}_Y$ of the socket $\mathbf{11}_Y$, and none of the burrs BR1 and BR2 are exposed to the opening $\mathbf{112}_Y$.

Accordingly, the ignition coil 100 can reliably apply a high voltage to a spark plug while the primary coil 1 of the coil 100 reduces the incidence rate of short circuits when the center core 10*a* of the coil 1 is formed by compressing and molding magnetic powder.

Further, because each of the dies D1*a* and D2*a* has the inner wall formed in the releasing taper, the width of the collar portion 101*a* between the longer sides of the portion 101*a* is shortened as the position of the width recedes from the center line. Therefore, during the release of the collar portion 101*a* from the dies D1*a* and D2*a*, the friction between the inner wall of each die and the side surfaces of the portion 101*a*, extending in the direction parallel to the center axis Ac1 between the longer sides, is reduced. Accordingly, the center core 10*a* can be smoothly released from the dies D1*a* and D2*a*.

Assuming that a collar portion having two longer sides extending straight is formed and is released from dies moved in directions which are opposite to each other and is perpendicular to the center line which partitions each of the longer sides of the rectangle of the collar portion into two segments, the friction between each die and the collar portion becomes large. Therefore, when the collar portion is released from dies, the collar portion is sometimes damaged or broken.

In this embodiment, the collar portion 101*a* of the center core 10*a* is disposed in the socket $\mathbf{11}_Y$. However, the collar portion 101*a* of the center core 10*a* may be disposed in the socket 11 shown in FIG. 3.

Third Embodiment

Figure 22A:
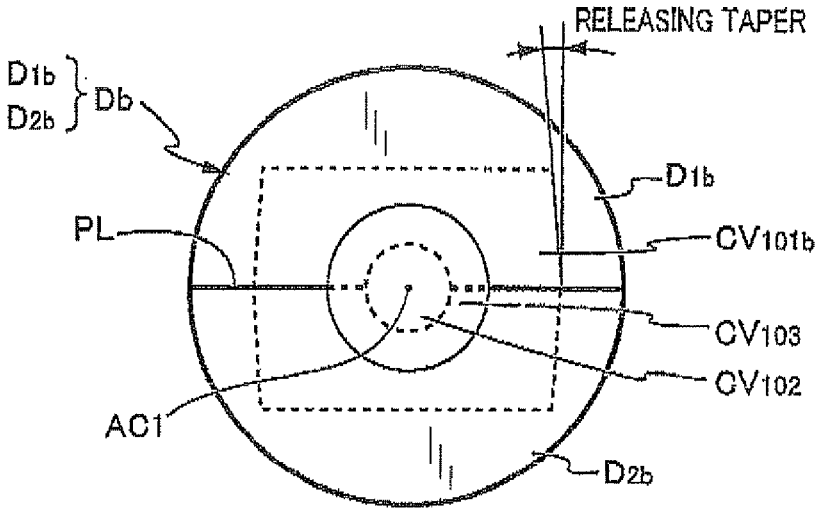
FIG. 22A is a bottom view of two divided dies according to the third embodiment of the present invention.
Figure 22B:
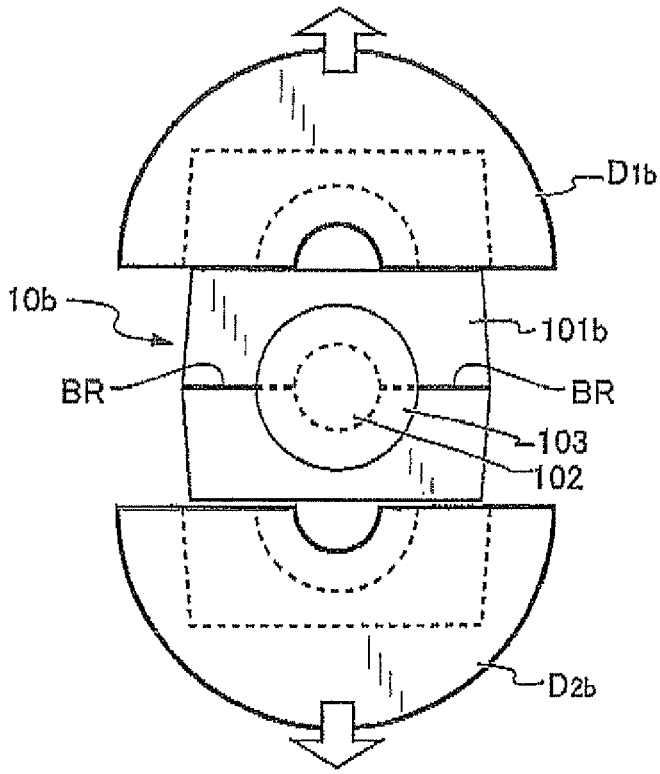
FIG. 22B is a bottom view of the divided dies released from the core.
Figure 23:
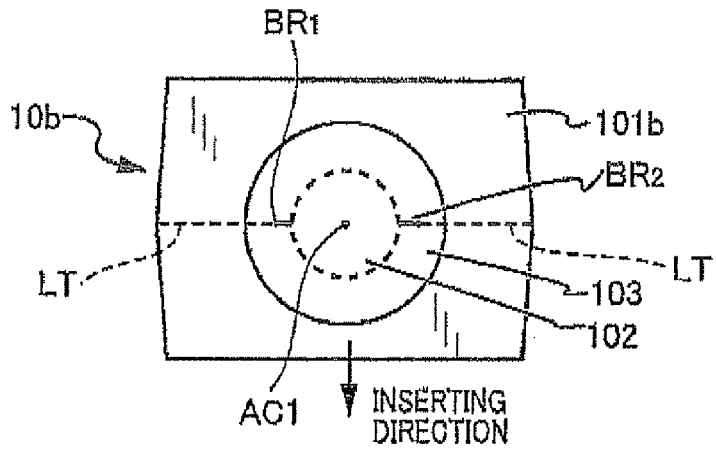
FIG. 23 is a bottom view of the center core with burrs, remaining after burr removal, formed according to the third embodiment.
Figure 24:
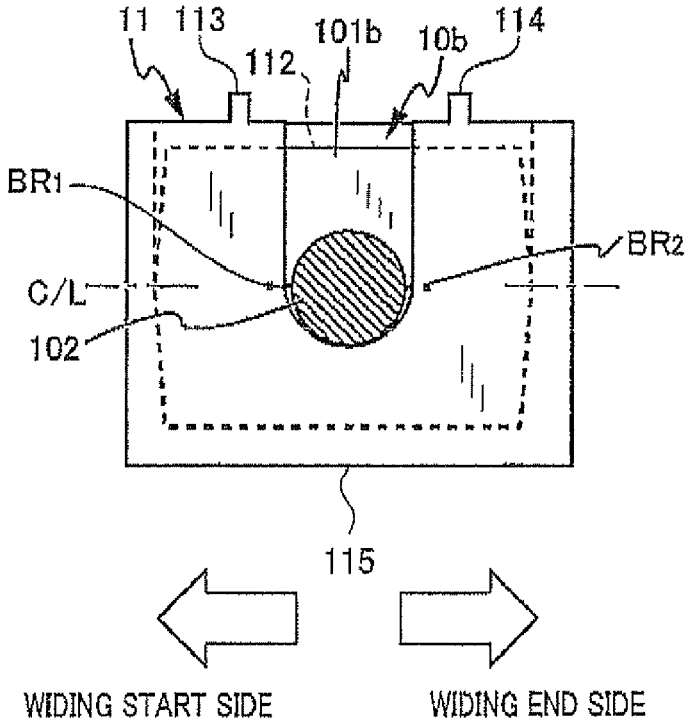
FIG. 24 is a bottom view, partially in cross-section, of the center core fixed to a connector socket according to the third embodiment.

FIG. 22A is a bottom view of two divided dies for forming a center core according to the third embodiment, and FIG. 22B is a bottom view of the divided dies released from the core. FIG. 23 is a bottom view of the center core with burrs, remaining after burr removal, formed according to the third embodiment. FIG. 24 is a bottom view, partially in cross-section, of the center core fixed to a connector socket according to the third embodiment.

As shown in FIG. 22A and FIG. 22B, a core molding die Pb formed in the shape of a center core is divided into two divided dies D1*b* and D2*b* having the same shape. The divided dies D1*b* and D2*b* forms a center core 10*b* composed of a collar portion 101*b* and the portions 102, 103 and 105 by compressing and molding the magnetic powder. The portion

101*b* extends from the end 104 of the smaller diameter portion 102 in outer directions perpendicular to a center axis Ac1 of the core 10*b*. The portion 101*b* has outer surfaces forming substantially a rectangle on a plane perpendicular to the center axis Ac1.

The divided dies D1*b* and D2*b* have dividing lines PL extending along a center line of the rectangle of the collar portion 101*b* of the core 10*b* packed in the dies D1*b* and D2*b*. This center line partitions each of two shorter sides of the rectangle of the portion 101*b* into substantially two equal segments. Burrs BR are formed on the core 10*b* along trace lines of the core 10*b* extending along the dividing lines PL.

Each of the dies D1*b* and D2*b* preferably have an inner wall formed in a releasing taper to form the collar portion 101*b* tapered in the shape of the releasing taper. More specifically, the width between the longer sides of the rectangle is gradually shortened as the position of the width recedes from the center line. Therefore, when the dies D1*b* and D2*b* are moved in directions, which are opposite to each other and is perpendicular to the centerline (or longer sides of the portion 101*b*), the dies D1*b* and D2*b* can be smoothly released from the collar portion 101*b*.

As shown in FIG. 23, the center core 10*b* has a burr BR1 and a burr BR2 remaining after the removal of the burrs BR. These burrs BR1 and BR 2 are located on the root 104 of the smaller diameter portion 102 along the trace lines LT. The burr BR1 and the burr BR2 are positioned opposite to each other with respect to the center axis Ac1. The collar portion 101*b* of the core 10*b* is inserted into the socket 11 along an inserting direction perpendicular to the center line of the collar portion 101*b*.

As shown in FIG. 24, to place the collar portion 101*b* of the core 10*b* in the socket 11, one longer side of the portion 101*b* is first inserted into the socket 11, and the other longer side of the portion 101*b* is finally inserted into the socket 11. Therefore, one longer side of the portion 101*b* faces the bottom wall 115 of the socket 11, while the other longer side of the portion 101*b* faces the open end of the socket 11. The center line is substantially perpendicular to the direction, directed from the open end to the bottom wall 115 of the socket 11.

Because the diameter of the smaller diameter portion 102 is substantially equal to the width of the opening 112, the burrs BR1 and BR2 closely face the side wall 111 of the socket 11, and none of the burrs BR1 and BR2 are exposed to the opening 112.

Accordingly, the ignition coil 100 can reliably apply a high voltage to a spark plug while the primary coil 1 of the coil 100 reduces the incidence rate of short circuits when the center core 10*b* of the coil 1 is formed by compressing and molding magnetic powder.

Further, because each of the dies D1*b* and D2*b* has the inner wall formed in the releasing taper, the width of the collar portion 101*b* between the shorter sides of the portion 101*b* is shortened as the position of the width recedes from the center line. Therefore, during the release of the collar portion 101*b* from the dies D1*b* and D2*b*, the friction between the inner wall of each die and the side surfaces of the portion 101*b*, extending in the direction parallel to the center axis Ac1 between the shorter sides, is reduced. Accordingly, the center core 10*b* can be smoothly released from the dies D1*b* and D2*b*.

Assuming that a collar portion having two shorter sides extending straight is formed and is released from dies moved in directions which are opposite to each other and is perpendicular to the center line which partitions each of the shorter sides of the rectangle of the collar portion into two segments, the friction between each die and the collar portion becomes large. Therefore, when the collar portion is released from dies, the collar portion is sometimes damagedor broken.

In this embodiment, the collar portion 101*b* of the center core 10*b* is disposed in the socket 11. However, the collar portion 101*b* of the center core 10*b* may be disposed in the socket $\mathbf{11}_Y$ shown in FIG. 21.

What is claimed is:

1. An ignition coil having a primary coil, the primary coil comprising:

a center core, farmed by compressing magnetic powder packed in a core die, having a smaller diameter portion, a larger diameter portion, a winding body portion being composed of the smaller diameter portion and the larger diameter portion and being formed substantially in a columnar shape with a step, and a collar portion extending from a root of the smaller diameter portion in outer directions, perpendicular to a center axis of the center core, so as to form substantially a rectangle on a plane perpendicular to the center axis;

a connector socket, formed in a cylindrical shape to fixedly hold the collar portion of the center core, having a bottom wall, a side wall surrounding the bottom wall so as to have an opened end and an opening, the opened end being placed opposite to the bottom wall through the side wall, the opening extending from the opened end toward the bottom wall, the collar portion of the center core being fixedly held in a space surrounded by the bottom wall and the side wall, the root of the smaller diameter portion being located in the opening, a winding start catching portion disposed on the side wall, and a winding end catching portion disposed on the side wall on a winding end side of the smaller diameter portion; and a winding which is wound on the winding body portion while a winding start portion of the winding is caught by the winding start catching portion on a winding start side of the smaller diameter portion and while a winding end portion of the winding is caught by the winding end catching portion on a winding end side of the smaller diameter portion opposite to the winding start side, wherein the core die is composed of two divided dies divided through a dividing line which extends along a diagonal line of the rectangle of the collar portion packed in the dies, and wherein the root of the smaller diameter portion on a segment of the diagonal line positioned on the winding start side is exposed to the opening of the connector socket while the root is substantially covered with the side wall on another segment of the diagonal line positioned on the winding end side.

2. The ignition coil according to claim 1, wherein the center core has a first burr on the root located on the diagonal line on the winding start side and has a second burr on the root located on the diagonal line on the winding end side, the first burr is exposed to the opening, and the second burr is not exposed to the opening.

3. The ignition coil according to claim 1, wherein the winding has a plurality of turns wound in a plurality of winding layers such that the first layer of winding is directly in contact with the winding body portion, and the winding start portion of the winding extends from a specific turn of the winding which is located to be nearest to the collar portion of the center core among the turns of winding in the first winding layer and is supported by the side wall of the connector socket.

4. The ignition coil according to claim 1, wherein the root exposed to the opening of the connector socket on the winding start side is located on an opened side of the collar portion, on which the opened end of the side wall and the catching portions are located, and the root covered with the side wall on the winding end side is located on a closed side of the collar portion opposite to the opened side.

5. The ignition coil according to claim 1, wherein the opening is formed substantially in a U shape having a semicircle at an area of the opening nearest to the bottom wall, and a width of the opening in a direction from the winding start side to the winding end side is substantially equal to a diameter of the smaller diameter portion of the center core.

6. An ignition coil having a primary coil, the primary coil comprising:

a center core, formed by compressing magnetic powder packed in a core die, having a smaller diameter portion, a larger diameter portion, a winding body portion being composed of the smaller diameter portion and the larger diameter portion and being formed substantially in a columnar shape with a step, and a collar portion extending from a root of the smaller diameter portion in outer directions, perpendicular to a center axis of the center core, so as to form substantially a rectangle on a plane perpendicular to the center axis;

a connector socket, formed in a cylindrical shape to fixedly hold the collar portion of the center core, having a bottom wall, a side wall surrounding the bottom wall so as to have an opened end and an opening, the opened end being placed opposite to the bottom wall through the side wall, the opening extending from the opened end toward the bottom wall, the collar portion of the center core being fixedly held in a space surrounded by the bottom wall and the side wall, the root of the smaller diameter portion being located in the opening, a winding start catching portion disposed on the side wall, and a winding end catching portion disposed on the side wall; and a winding which is wound on the winding body portion while a winding start portion of the winding is caught by the winding start catching portion and while a winding end portion of the winding is caught by the winding end catching portion, wherein the core die is composed of two divided dies divided through a dividing line extending along a center line which partitions the rectangle formed on the collar portion of the center core, located in the divided dies, into two equal parts, and is substantially perpendicular to a direction directed from the opened end to the bottom wall of the connector socket holding the center core.

7. The ignition coil according to claim 6, wherein the center line of the center core divides each of two longer sides of the rectangle formed on the collar portion of the center core.

8. The ignition coil according to claim 6, wherein the center line of the center core divides each of two shorter sides of the rectangle formed on the collar portion of the center core.

9. The ignition coil according to claim 6, wherein each of the divided dies has an inner wall formed in a releasing taper to form the collar portion such that a width between the sides of the collar portion is gradually shortened as a position of the width recedes from the center line.

10. The ignition coil according to claim 6, wherein the center core has a first burr on a first portion of the root located on the center line and has a second burr on a second portion of the root opposite to the first portion with respect to the center axis of the center core, and none of the first burr and the second burr are exposed to the opening.

11. The ignition coil according to claim 6, wherein the opening is formed substantially in a U shape having a semicircle at an area of the opening nearest to the bottom wall, and a diameter of the semicircle is substantially equal to a diameter of the smaller diameter portion of the center core.

* * * * *